US008894325B2

(12) United States Patent
Varney et al.

(10) Patent No.: US 8,894,325 B2
(45) Date of Patent: Nov. 25, 2014

(54) SUBMERGED HYDROCARBON RECOVERY APPARATUS

(75) Inventors: Brian Wilson Varney, Calgary (CA); Thomas Joseph Kuelker, Calgary (CA)

(73) Assignee: Oxus Recovery Solutions, Inc., Calgary (CA)

( * ) Notice: Subject to any disclaimer, the term of this patent is extended or adjusted under 35 U.S.C. 154(b) by 77 days.

(21) Appl. No.: 13/695,635

(22) PCT Filed: May 3, 2011

(86) PCT No.: PCT/CA2011/050269

§ 371 (c)(1), (2), (4) Date: Nov. 1, 2012

(87) PCT Pub. No.: WO2011/137535

PCT Pub. Date: Nov. 10, 2011

(65) Prior Publication Data

US 2013/0046126 A1 Feb. 21, 2013

Related U.S. Application Data

(60) Provisional application No. 61/331,383, filed on May 4, 2010, provisional application No. 61/347,369, filed on May 21, 2010.

(51) Int. Cl.

| | |
|---|---|
| ***E21B 43/01*** | (2006.01) |
| ***B63C 11/52*** | (2006.01) |
| ***B63B 35/32*** | (2006.01) |

(52) U.S. Cl.

CPC ..... *E21B 43/0122* (2013.01); *B63C 11/52* (2013.01); *B63B 35/32* (2013.01)

USPC ..... 405/60; 405/64

(58) Field of Classification Search

CPC ..... E21B 43/0122

USPC ..... 405/60, 63, 64, 65

See application file for complete search history.

(56) References Cited

U.S. PATENT DOCUMENTS

| | | | |
|---|---|---|---|
| 1,017,486 | A | 2/1912 | Williamson |
| 1,859,322 | A | 5/1932 | Wilson |
| 1,859,606 | A | 5/1932 | Sievern |
| 2,132,800 | A | 10/1938 | Payton |

(Continued)

FOREIGN PATENT DOCUMENTS

| | | | | |
|---|---|---|---|---|
| FR | 2852917 A1 * | 10/2004 | | |
| GB | 2063776 A * | 6/1981 | ..... | E02B 15/04 |
| WO | WO 8100875 A1 * | 4/1981 | ..... | E21B 43/01 |

OTHER PUBLICATIONS

How Does Subsea Processing Work?; http://www.rigzone.com/insight.asp?insight_id=327&c_id=17.

*Primary Examiner* — John Kreck

(74) *Attorney, Agent, or Firm* — Sean W Goodwin; Linda M Thompson

(57) ABSTRACT

A submerged hydrocarbon recovery apparatus for the collection and conveyance of fluids from sub surface leaks to the water body surface. The apparatus comprises a hydrocarbon fluid collector having an opening for receiving and collecting fluids emanating from an underwater hydrocarbon leak; a floatation assembly located below the water surface at a depth not affected by surface disturbances; and a conduit extending between the fluid collector and floatation assembly. The apparatus includes components to prevent the formation of hydrates or accumulation of solids that would obstruct the conveyance of fluids.

38 Claims, 11 Drawing Sheets

(56) References Cited

U.S. PATENT DOCUMENTS

| | | | | | |
|---|---|---|---|---|---|
| 3,017,934 | A | | 1/1962 | Rhodes | |
| 3,327,667 | A | | 6/1967 | Manning | |
| 3,339,512 | A | | 9/1967 | Siegel | |
| 3,389,559 | A | | 6/1968 | Logan | |
| 3,500,841 | A | * | 3/1970 | Campbell | 137/13 |
| 3,548,605 | A | * | 12/1970 | Fontaine et al. | 405/60 |
| 3,550,385 | A | | 12/1970 | Lowd | |
| 3,567,019 | A | | 3/1971 | Headrick | |
| 3,572,278 | A | | 3/1971 | Knapp | |
| 3,599,434 | A | | 8/1971 | Missud | |
| 3,599,590 | A | | 8/1971 | Rego | |
| 3,635,347 | A | | 1/1972 | Rupnick | |
| 3,643,741 | A | | 2/1972 | Miranda | |
| 3,653,215 | A | | 4/1972 | Crucet | |
| 3,658,181 | A | * | 4/1972 | Blair | 210/170.05 |
| 3,664,136 | A | | 5/1972 | Laval | |
| 3,666,100 | A | | 5/1972 | Madej | |
| 3,667,605 | A | | 6/1972 | Zielinski | |
| 3,674,150 | A | * | 7/1972 | Lejeune | 210/245 |
| 3,681,923 | A | | 8/1972 | Hyde | |
| 3,717,001 | A | | 2/1973 | Tam | |
| 3,719,048 | A | | 3/1973 | Arne | |
| 3,724,662 | A | | 4/1973 | Ortiz | |
| 3,745,773 | A | | 7/1973 | Cunningham | |
| 3,762,548 | A | | 10/1973 | McCabe | |
| 3,777,497 | A | | 12/1973 | Edwards | |
| 3,800,951 | A | | 4/1974 | Mourlon | |
| 3,813,887 | A | | 6/1974 | Kruger | |
| 3,855,656 | A | | 12/1974 | Blenkarn | |
| 3,858,401 | A | | 1/1975 | Watkins | |
| 3,866,676 | A | | 2/1975 | Burns | |
| 3,879,951 | A | | 4/1975 | Mason | |
| 3,889,477 | A | | 6/1975 | Tam | |
| 3,898,846 | A | | 8/1975 | McCabe | |
| 3,943,720 | A | | 3/1976 | Milgram | |
| 3,979,291 | A | | 9/1976 | in't Veld | |
| 3,981,154 | A | | 9/1976 | Hix | |
| 4,047,390 | A | | 9/1977 | Boyce | |
| 4,060,175 | A | | 11/1977 | Rysaard | |
| 4,099,560 | A | | 7/1978 | Fischer | |
| 4,176,986 | A | | 12/1979 | Taft | |
| 4,234,047 | A | | 11/1980 | Mott | |
| 4,283,159 | A | | 8/1981 | Johnson | |
| 4,290,714 | A | | 9/1981 | Strange | |
| 4,309,127 | A | | 1/1982 | Jacobs | |
| 4,318,442 | A | * | 3/1982 | Lunde et al. | 166/357 |
| 4,324,505 | A | * | 4/1982 | Hammett | 405/60 |
| 4,358,218 | A | | 11/1982 | Graham | |
| 4,358,219 | A | | 11/1982 | Burns | |
| 4,365,912 | A | | 12/1982 | Burns | |
| 4,373,834 | A | | 2/1983 | Grace | |
| 4,388,188 | A | | 6/1983 | Morris | |
| 4,395,157 | A | | 7/1983 | Cunningham | |
| 4,402,632 | A | | 9/1983 | Cook | |
| 4,405,258 | A | | 9/1983 | O'Rourke | |
| 4,421,436 | A | | 12/1983 | Burns | |
| 4,422,801 | A | | 12/1983 | Hale | |
| 4,433,940 | A | | 2/1984 | Harrison | |
| 4,440,523 | A | | 4/1984 | Milgram | |
| 4,449,850 | A | | 5/1984 | Cessou et al. | |
| 4,531,860 | A | | 7/1985 | Barnett | |
| 4,545,437 | A | | 10/1985 | Denison | |
| 4,557,332 | A | | 12/1985 | Denison | |
| 4,566,824 | A | | 1/1986 | Minier | |
| 4,616,707 | A | | 10/1986 | Langner | |
| 4,617,998 | A | | 10/1986 | Langner | |
| 4,634,314 | A | | 1/1987 | Pierce | |
| 4,643,612 | A | | 2/1987 | Bergeron | |
| 4,653,960 | A | | 3/1987 | Chun | |
| 4,790,936 | A | | 12/1988 | Renfrow | |
| 4,821,804 | A | | 4/1989 | Pierce | |
| 4,889,447 | A | | 12/1989 | Strange | |
| 4,936,710 | A | | 6/1990 | Petty | |
| 5,035,536 | A | | 7/1991 | von Winckelmann | |
| 5,046,896 | A | | 9/1991 | Cole | |
| 5,114,273 | A | | 5/1992 | Anderson | |
| 5,213,444 | A | | 5/1993 | Henning | |
| 5,385,427 | A | | 1/1995 | Katelev | |
| 5,407,301 | A | | 4/1995 | Lydiard | |
| 5,470,467 | A | | 11/1995 | Soule | |
| 5,575,586 | A | | 11/1996 | Lydiard | |
| 5,950,732 | A | | 9/1999 | Agee et al. | |
| 6,004,074 | A | | 12/1999 | Skanks | |
| 6,089,789 | A | | 7/2000 | Santamaria | |
| 6,155,748 | A | | 12/2000 | Allen | |
| 6,257,337 | B1 | | 7/2001 | Wells | |
| 6,457,527 | B2 | | 10/2002 | Wells | |
| 6,994,159 | B2 | | 2/2006 | Wendland | |
| 7,008,141 | B2 | | 3/2006 | Fitzgerald | |
| 7,556,739 | B1 | | 7/2009 | Johnston-Dhuet et al. | |
| 8,016,030 | B1 | | 9/2011 | Prado et al. | |
| 8,297,361 | B1 | | 10/2012 | Root | |
| 8,381,578 | B2 | | 2/2013 | Sweeney et al. | |
| 8,517,632 | B2 | | 8/2013 | Later et al. | |
| 8,534,365 | B2 | * | 9/2013 | Dighe | 166/364 |
| 2002/0153140 | A1 | * | 10/2002 | Botrel | 166/302 |
| 2002/0157833 | A1 | | 10/2002 | Wilson | |
| 2005/0013666 | A1 | | 1/2005 | Chianis | |
| 2005/0025574 | A1 | | 2/2005 | Lazes | |
| 2005/0103498 | A1 | | 5/2005 | Yemington | |
| 2012/0087729 | A1 | * | 4/2012 | Oesterberg et al. | 405/60 |
| 2012/0181041 | A1 | | 7/2012 | Willman | |
| 2012/0213588 | A1 | | 8/2012 | Shifferaw | |
| 2012/0241161 | A1 | | 9/2012 | Edwards et al. | |
| 2012/0247781 | A1 | | 10/2012 | Noble et al. | |

* cited by examiner (PLAN)

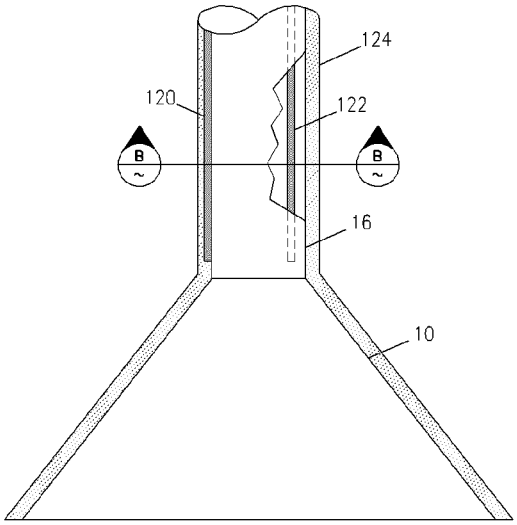
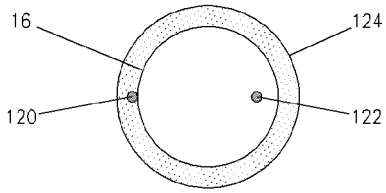
FIG. 8A
(SECTION B-B)
FIG. 8
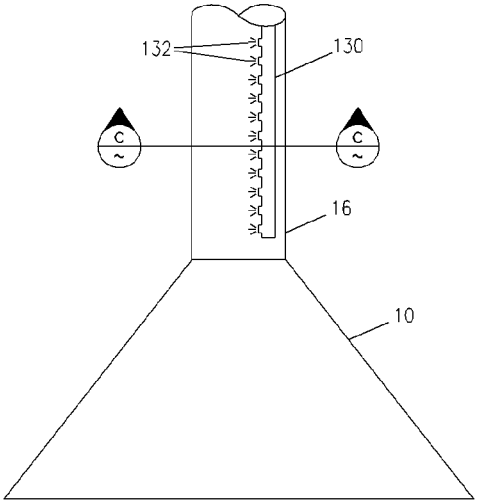
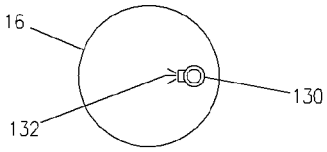
FIG. 9A
(SECTION C-C)
FIG. 9

SUBMERGED HYDROCARBON RECOVERY APPARATUS

TECHNICAL FIELD

Embodiments are generally related to the recovery of fluids from leaks below the water surface.

BACKGROUND

Submerged fluid leaks can occur naturally (due to seismic activity), be man made, the result of sunken vessels, the result of faulty materials or equipment (e.g. well blowouts) or the result of other failures. These leaks often involve toxic fluids that can adversely affect the environment. Therefore a means of collecting and directing the fluid to suitable containment in a controlled manner is very important.

Often these fluids are of a lower density than that of the surrounding water and as a result the fluid will "float" to the surface of the water body where it will disperse spreading its toxicity over large areas and thereby significantly increasing the devastating impact on the plants and animals that live in the affected ecosystem. These fluids may also disperse throughout the water column (sometimes in the form of subsea plumes) adversely affecting the ecosystem.

Another issue with sub surface leaks, from for example, a leaking oil well, pipeline, or fissure, is the possibility of hydrate formation which may inhibit the successful recovery of the leaking fluids. Hydrates are clathrates that can form in the presence of hydrocarbons (e.g. natural gas) and low temperature water under high pressure. Furthermore, there is a possibility of other byproducts (e.g. asphaltenes, solids, solids forming products, etc.) within the leaking fluid that may inhibit the conveyance of the fluid from the leak source to the surface recovery facilities simply by accumulating to the point that the conveying systems (e.g. collector, chimney or piping or other conduit systems) are partially or wholly plugged.

SUMMARY

The difference in density between the leaking fluid and surrounding water may be used to transport or float the fluid to the surface.

In an embodiment, there is provided an apparatus for underwater hydrocarbon fluid spill containment, comprising: a hydrocarbon fluid collector having an opening for receiving and collecting fluids emanating from an underwater hydrocarbon leak; a flotation assembly; a conduit extending between the hydrocarbon fluid collector and the flotation assembly for supply of collected fluids from the hydrocarbon fluid collector to the flotation assembly; and the hydrocarbon fluid collector disposed over the underwater hydrocarbon leak.

In various embodiments: the hydrocarbon fluid collector may be freely suspended over the underwater hydrocarbon leak, without positioning cables and without being anchored; thrusters may be provided on the hydrocarbon fluid connector for lateral and/or vertical positioning of the hydrocarbon fluid connector; flotation or ballast devices may be supplied for control of vertical positioning; a source of de-coalescent such as compressed gas or surfactant or both may be disposed to inject de-coalescent into the hydrocarbon fluid collector or into the conduit or into both the hydrocarbon fluid collector or into the conduit; the flotation assembly being submersible; there may be provided means to control fluid density in the conduit comprising one or more openings in the conduit having a controllable opening size; a removable physical barrier such as a gel plug or removable cover may be provided in or attached to the hydrocarbon fluid collector for preventing blockages forming in the hydrocarbon fluid collector; a source of a hydrate dissipating medium such as a heater or chemical source may be provided below, in or attached to the hydrocarbon fluid collector or in or attached to the conduit for preventing hydrate formation or dissipating hydrate that has formed; the source may include a perforated tube in the collector or conduit; the hydrocarbon fluid collector may be disposed over the underwater hydrocarbon leak, with a chain of plume concentrators disposed between the underwater hydrocarbon leak and the hydrocarbon fluid collector, the chain of plume concentrators collimating the plume of fluids emanating from the underwater hydrocarbon leak; there may be plural conduits, each conduit of the plural conduits extending from the hydrocarbon fluid collector and being in fluid communication with the flotation assembly for supply of collected fluids from the hydrocarbon fluid collector to the flotation assembly, the hydrocarbon fluid collector being configured to convey to each of the plural conduits an undifferentiated portion of the fluids emanating from the underwater hydrocarbon leak.

In a further embodiment, there is provided a method of protecting against an underwater spill, comprising providing a hydrocarbon fluid collector having an opening for receiving and collecting fluids emanating from an underwater hydrocarbon leak, the hydrocarbon fluid collector being freely suspended over an underwater hydrocarbon leak that is discharging fluids into water, providing a flotation assembly; and collecting fluid discharged from the underwater hydrocarbon leak by capturing the fluids with the hydrocarbon fluid collector and flowing the fluids through a conduit extending between the hydrocarbon fluid collector and the flotation assembly.

In various embodiments of the method there is provided: the hydrocarbon fluid collector is freely suspended over the underwater hydrocarbon leak, without positioning cables and without being anchored; lateral and/or vertical positioning of the hydrocarbon fluid connector is adjusted by using thrusters; injecting de-coalescent such as compressed gas or surfactant or both into the hydrocarbon fluid collector and into the conduit; injecting compressed gas into the hydrocarbon fluid collector or into the conduit or into both the hydrocarbon fluid collector or into the conduit when the conduit conveys fluids comprising liquids and gases; providing a submerged flotation assembly; transferring fluids from the submerged flotation assembly to a surface vessel; controlling fluid density in the conduit by providing one or more openings in the conduit and adjusting an opening size of the one or more openings; preventing blockages forming in the hydrocarbon fluid collector by providing a removable physical barrier such as a gel plug or removable cover in or attached to the hydrocarbon fluid collector; preventing blockages forming in the hydrocarbon fluid collector by providing a source of hydrate dissipating medium below or in the hydrocarbon fluid collector or in the conduit for preventing hydrate formation or dissipating hydrate that has formed; the source of hydrate dissipating medium may be a heater or chemical source, and may be in the hydrocarbon fluid collector or the conduit, and may include a perforated tube in the hydrocarbon fluid collector or the conduit; the hydrocarbon fluid collector being disposed over the underwater hydrocarbon leak, with a chain of plume concentrators disposed between the underwater hydrocarbon leak and the hydrocarbon fluid collector, the chain of plume concentrators collimating the plume of fluids emanating from the underwater hydrocarbon leak; plural conduits, each conduit of the plural conduits extending from the hydrocarbon fluid collector and being in fluid communication with the flotation assembly, the hydrocarbon fluid collector being configured to convey to each of the plural conduits an undifferentiated portion of the fluids emanating from the underwater hydrocarbon leak.

In still further embodiments of both the method and apparatus, there may be provided a separation facility associated with the flotation assembly and connected to receive fluid from the conduit through a surface conduit; the flotation assembly comprises hydrocarbon fluid storage or a transfer facility for conveying hydrocarbons to fluid storage; the conduit comprises one or more check valves; a pump is provided to initiate flow in the conduit; there are provided remotely controlled length adjustable anchor lines for anchoring the hydrocarbon fluid collector; the apparatus is arranged over a submerged hydrocarbon fluid leak to provide a self-sustaining flow of hydrocarbon fluid through the conduit; there are provided thrusters attached to the flotation assembly for positioning the flotation assembly relative to the collector.

These and other aspects of the device and method are set out in the claims, which are incorporated here by reference.

BRIEF DESCRIPTION OF THE FIGURES

Embodiments will now be described with reference to the Figures, in which like reference characters denote like elements, by way of example, and in which:

FIG. 1A is side view of a multi chimney (conduit) apparatus.

FIGS. 7A, 7B, and 7C are bottom up views of example patterns of electric heating elements.

FIG. 8 is a side view of internal and external heating elements fixed to a chimney. FIG. 8A shows a cross section along the lines B-B of FIG. 8.

FIG. 9 is a side view of a perforated chemical tube inside the chimney. FIG. 9A shows a cross section along the lines C-C of FIG. 9.

DETAILED DESCRIPTION

Figure 1:
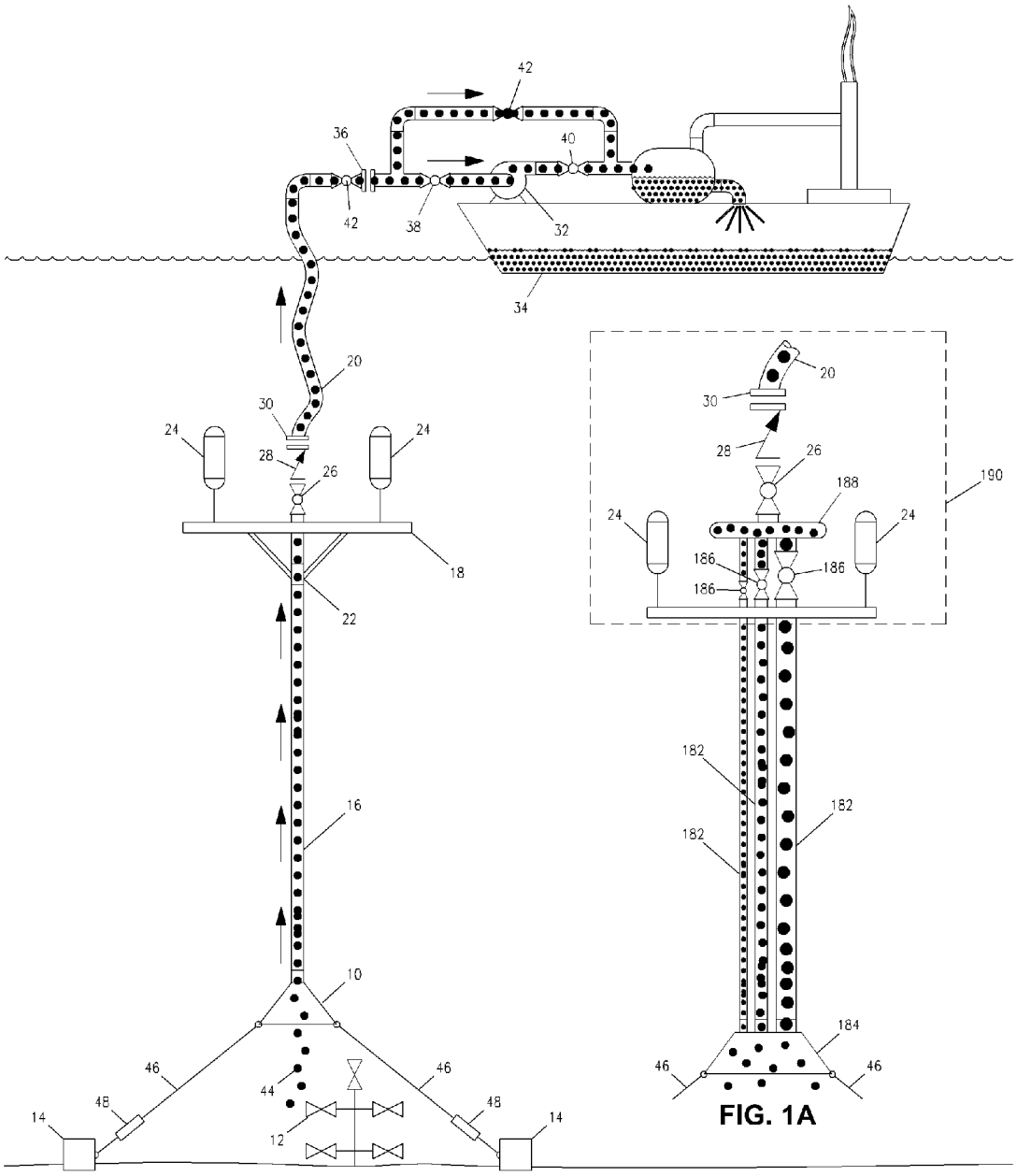
FIG. 1 is a side view of an embodiment of an overall apparatus.

Immaterial modifications may be made to the embodiments described here without departing from what is covered by the claims. In the claims, the word "comprising" is used in its inclusive sense and does not exclude other elements being present. The indefinite article "a" before a claim feature does not exclude more than one of the feature being present. Each one of the individual features described here may be used in one or more embodiments and is not, by virtue only of being described here, to be construed as essential to all embodiments as defined by the claims.

The difference in density between the leaking fluid and surrounding water may be used to transport or float the fluid to the surface. An embodiment of the apparatus disclosed here captures the leaking lower density fluid with a hydrocarbon fluid collector and confines the fluid in a conduit (e.g. chimney) that extends to or near the surface. The fluids will at least typically comprise a mixture of liquids and gases, and possibly also solids to a varying degree. As more fluid rises up through the chimney (and more of the water originally in the chimney is displaced out of the chimney) the fluid pressure at the top of the chimney and/or velocity at which it flows up the chimney (and thus fluid flow rate) will increase. If the flow rate is left unabated, then the velocity at which the lower density fluid rises up through the conduit will increase and may become unwieldy. A back pressure/flow control device or valve located at the top end of the chimney can be utilized to slow the flow rate of the fluid and thereby increase the pressure of the fluid in the chimney at the surface. This pressure can then be utilized to transport the fluid into a nearby tanker and/or other storage facility or through a pipeline to nearby onshore facilities, if available. The flowing of the lower density fluid up through the chimney will be initiated automatically (i.e. it is self priming) as soon as the lower density fluid begins to be collected and rise up through the chimney. The speed at which the flow commences and increases is a function of the chimney diameter. The larger the diameter, the quicker that the flow rate is established and will increase. An alternative embodiment may use a smaller diameter chimney together with a pump (e.g. a multiphase pump) to increase the rate at which the fluid is drawn into the chimney and thereby greatly reduce the time required to commence and establish the self sustaining flow of the fluid up through the chimney. Once flow has been established, the pump can be bypassed.

The amount of energy (i.e. pressure) available to transport the fluid up the chimney is a function of the density differential between the leaking fluid to be transported through the chimney and the surrounding water, the depth of the leak source and gravity. As pressure loss due to fluid flow velocity, chimney length and wall friction is relatively low, then the greater the depth of the fluid leak, the greater the resulting pressure (i.e. energy) available to transport the fluid to the surface and, for any given flow rate, the smaller the required chimney diameter. A smaller diameter chimney may be easier to store and deploy.

The following is provided to facilitate an understanding of some of the innovative features unique to the present apparatus. A full appreciation of the various aspects of the apparatus and methods can be gained by taking the entire specification, claims, drawings, and abstract as a whole.

An embodiment of a submerged hydrocarbon recovery apparatus exploits the difference in density between any leaking fluid with a specific gravity less than that of the surrounding water (e.g. hydrocarbons) to safely transport the leaking fluid(s) from the source of the sub surface leak to containment and/or processing facilities located at the surface of the water body or nearby shore. The apparatus exploits the fact that the lower density fluid will float to the top of the water body.

An embodiment of the apparatus comprises an anchored (FIG. 1 for example) or freely suspended (FIG. 10) hydrocarbon fluid collector positioned or disposed above an underwater hydrocarbon leak such as a leaking well, riser or vessel. When freely suspended, the hydrocarbon fluid collector is positioned without positioning cables and without being anchored. The collector receives and collects fluid emanating from the underwater hydrocarbon leak and funnels it to a conduit or conduits through one or more outlets in the hydrocarbon fluid collector. The conduit or conduits rise toward the water surface and are held in suitable tension by connection to an inlet of a flotation assembly on or near the water surface. Hence the conduit or conduits extend between the outlet or outlets of the hydrocarbon fluid collector and one or more inlets of the flotation assembly. Piping (flexible or rigid as the case may warrant) conveys the fluid from the top of the chimney to conventional separation and fluid handling equipment and storage or transportation facilities. Alternatively, the piping may convey the fluid from the top of the chimney via a mooring buoy located on the water surface to conventional separation and fluid handling equipment and storage or transportation facilities.

An embodiment of the apparatus comprises a gel plug filling or partly filling the underside of the collector or a removable bottom plate to prevent hydrates, debris, sea-life, or other accumulations prior to initiation of the submerged leaking fluid recovery process.

An embodiment of the apparatus comprises a modular electrical heating component or plurality thereof that may be attached below or in the collector or the conduit or conduits to precondition (i.e. heat) the leaking fluid to prevent the formation of hydrates and thereby enhance the fluid flow up the conduit or conduits.

An embodiment of the apparatus comprises electrical heat element(s) that may be placed inside or outside the conduit or conduits to heat the recovered fluid and thereby prevent hydrate formation.

An embodiment of the apparatus comprises a perforated tube or system of perforated tubes inserted inside the conduit or conduits for their full or partial height for injection of chemicals (e.g. methanol for hydrate prevention/elimination, chemicals to enhance the chimney flow, or chemicals to unplug the chimney, etc.).

An embodiment of the apparatus comprises shortening the conduit length and increasing the mouth size of the collector, as required. Anchors may be replaced with submersible thruster mechanisms thereby allowing the collector position to be continually adjusted vertically and/or laterally to maintain position above the hydrocarbon leakage plume. Sensors may be added to the thrusters, collector or other component of the apparatus to provide feedback for where to best position the collector. Thrusters on the flotation assembly or at the end of the chimney may be employed to keep the entire chimney apparatus aligned above the leakage plume, as required. The collector will be sufficiently weighted to keep the apparatus vertically oriented as required. With this embodiment, the collector apparatus can effectively collect and convey leaking fluids while operating at some distance above from the leakage.

Additionally the conduit or conduits in both the mobile submerged hydrocarbon recovery apparatus and the anchored submerged hydrocarbon recovery apparatus may be pre-charged with high pressure gas (e.g. nitrogen, or similar) so that the recovery apparatus is immediately ready to begin recovery of a leaking fluid without the need for implementing any further initiation procedures (i.e. utilizing a pump and/or gas bubbles). Pre-charging the chimney may involve the displacing of all or some of the water in the submerged chimney with high pressure gas (e.g. nitrogen, or similar). The hydrocarbon recovery apparatus can then be stored in standby mode, as required.

An embodiment of the apparatus comprises replacing the conduit in both the mobile submerged hydrocarbon recovery apparatus and the anchored submerged hydrocarbon recovery apparatus with multiple conduits with varying diameters. It is understood that the various multiphase (e.g. gas, oil and water) flow regimes that may occur through a conduit (e.g. annular, mist, slug, etc.) are a function of the flow velocity in the conduit. By providing a selection of various chimney diameters that can either be utilized individually or in combination with each other the preferred flow regime can be achieved for a broad range of leakage fluid flow rates. The multiple chimneys may be manifolded together or connected individually to the surface vessel.

The following is a description of various apparatus for the collection and safe conveyance of fluids (including hydrocarbons, toxic or otherwise) from a submerged pipeline rupture, damaged submerged wellhead facilities, sunken vessels or any other submerged object, equipment or facility that might be leaking fluids (toxic or otherwise) into a water body, to containment and/or processing facilities located on the surface of the water body.

The apparatus functions in a manner similar to a chimney in that it relies on the differential in densities between the fluid (toxic or otherwise) being leaked and the surrounding water to power the conveyance of the fluid from the source of the sub-surface leak to above surface containment and/or processing facilities. The greater the differential in density between the surrounding water and the fluid in the chimney, the greater the amount of energy available to transport the fluid (toxic or otherwise) to the surface. Once the transportation process has been initiated it is self sustaining as long as a density differential between the surrounding water and the fluid in the chimney are maintained.

An embodiment of a submerged hydrocarbon recovery apparatus may comprise a number of components, as shown in FIG. 1. These include a conical hydrocarbon fluid collector 10 which is held in place directly over a leakage source 12 by an anchoring system 14 and 46, a conduit or chimney 16 for conveying (flowing) a leakage fluid 44 from the hydrocarbon fluid collector 10 to a flotation assembly 18 located at a depth not affected by surface disturbances (i.e. waves, tide, etc), and a flexible high pressure conduit 20 to transport the fluid from the flotation assembly 18 through a back pressure/flow control/bypass valve 42 located on a floating platform, barge or vessel 34. The conical collector 10 may be partly conical for example frusto-conical. Alternatively, the flexible high pressure conduit 20 may first convey the leakage fluid 44 from the flotation assembly 18 to a conventional mooring buoy located on the water surface which in turn is attached to a second flexible high pressure conduit 20 that connects to the back pressure/flow control/bypass valve 42 located on a floating platform, barge or vessel 34.

The flotation assembly 18 may include a framework and harness 22 for attaching and supporting the top portion of the chimney 16 and attaching multiple flotation bags or ballast 24. The flotation assembly 18 may include a shutoff valve 26, a backflow check valve 28 and a connection coupling 30 in order to facilitate the isolation and disconnection of the top portion of the chimney 16 from the surface facilities above. The conventional mooring buoy may also include a shutoff valve 26, a backflow check valve 28 and a connection coupling 30 in order to facilitate the isolation and disconnection of the top portion of the chimney 16 from the surface facilities above.

The backflow check valve 28 facilitates the priming of a pump 32 should one be installed to establish the initial flow through the chimney 16. A connection coupling 36 may be included to facilitate connection to the pump system or to other systems. The pump 32 may be equipped with an inlet valve 38 and outlet valve 40 to allow the pump 32 to be isolated after free flow is established. The pump 32 may be a multiphase pump. The floating platform, barge or vessel 34 may or may not include three phase separation facilities for separating the recovered leaking fluid(s) from the water and any associated gas entrained in the fluid and/or compression facilities to recompress the associated gas, if required, together with the associated piping, valving and flaring facilities.

An anchoring system, if used, comprising anchors 14 and cables 46 may be equipped with devices 48 for remotely (or otherwise) shortening/lengthening the anchor lines to allow for repositioning of the collector 10 to adjust for local currents or moving the collector 10 to new leakage locations.

The collector 10 may be in the shape of a cone, dome, pyramid or other shape that is wide on the bottom and narrow at the top with an opening at the bottom for receiving and collecting fluids emanating from the underwater hydrocarbon leak. The collector 10 is preferably designed in a manner that optimizes collection capacity and minimizes size (e.g. may be skirted). The diameter and/or length (i.e. depth) of the collector 10 ultimately may depend upon how fast the flow of the fluid can be established in the chimney 16. The quicker the flow can be established, the smaller the optimum collector 10 size that is required.

The conduit or chimney 16 for conveying the fluid is sized based upon the leakage rate and the density differential between the leaking fluid and the surrounding water and the depth of the leak source (and thus the available pressure differential). The greater the leakage rate and lower the available pressure differential, the larger the chimney 16 diameter, and vice versa.

The chimney 16 may or may not be rigid (i.e. coil able) but is designed to withstand any differential in pressure caused by the differential in density between the surrounding water and the fluid being conveyed and any longitudinal stresses imposed upon it from the anchoring system 14, 46 and 48 and flotation assembly 18. The chimney 16 may be designed in such a manner as to mitigate "vortex shedding" to prevent it from oscillating (i.e. vibrating) which may lead to fatigue and premature failure of the chimney 16.

The flotation assembly 18 applies the necessary lift that, when offset by the pull of the anchoring system 14, results in sufficient tension to stabilize the chimney 16 from any sub surface water disturbances such as currents. In an embodiment in which the hydrocarbon fluid collector 10 is not anchored, thrusters or controlled flotation devices may be used to vary the tension on the conduit or chimney 16.

Figure 2:
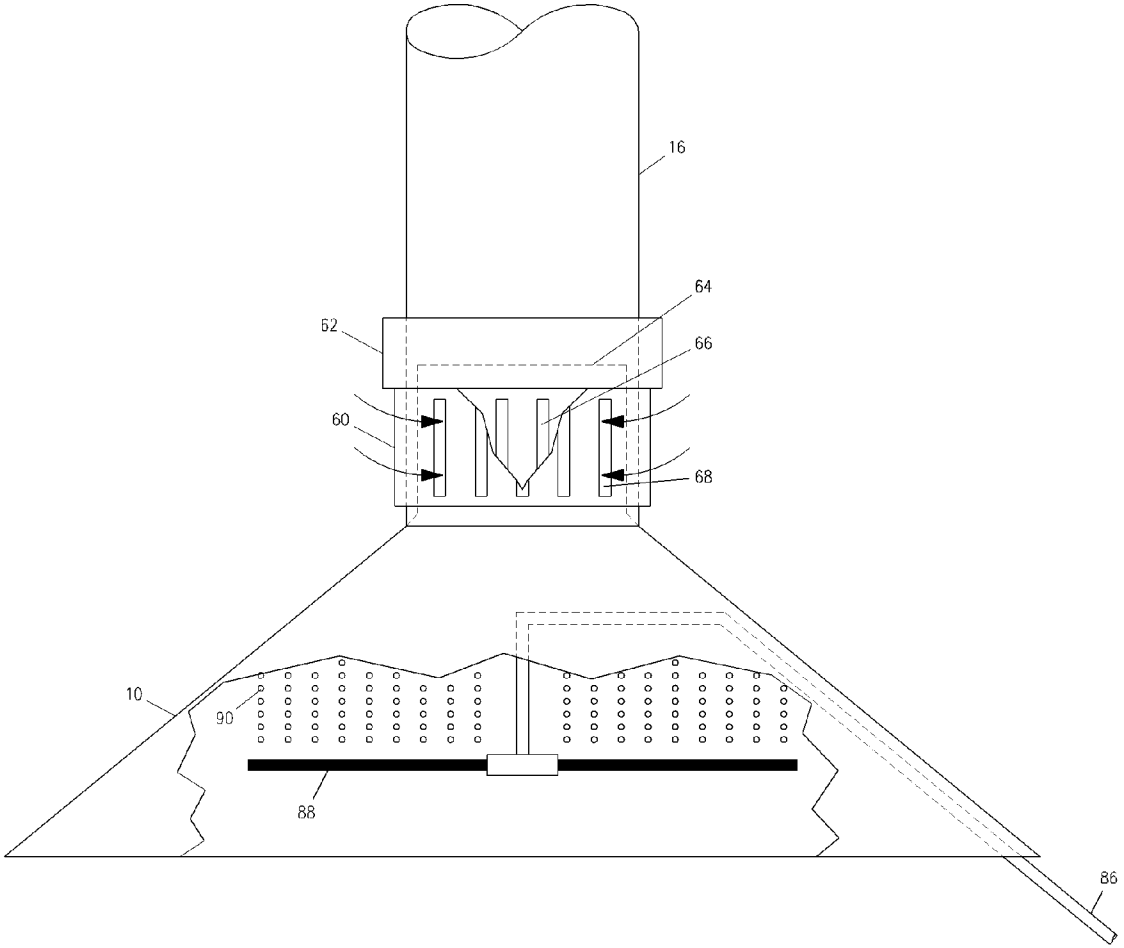
FIG. 2 is a side view of a fluid density modifier and priming/de-coalescing wand.

An additional improvement in the way of a fluid density modifier is described as follows and shown in FIG. 2. A top portion (i.e. the tubular portion) of the collector 10 can be made with one or more side openings 66 having a variable opening size. The openings 66 may be spaced (for example equally spaced but other configurations may be used) around the circumference and covered by an external band 60 made with an equal number of side openings 68 equally spaced around the circumference. In the closed position, the openings 66 in the top portion of the collector 10 and openings 68 in the external band 60 would be offset and thus not aligned. Moving the external band 60 would begin to bring the openings 66 in the top portion of the collector 10 into alignment with the openings 68 in the external band 60. Continuing to move the external band 60 in the same direction will eventually cause the openings 66 in the top portion of the collector 10 to be fully aligned with the openings 68 in the external band 60. Aligning the openings will allow water to be drawn in to or fluids to be withdrawn from the chimney 16. The position of the external band 60 and degree to which the openings are aligned can be adjusted by a local motor 62 controlled from the surface. The motor 62 can be electrical, hydraulic, or pneumatic as required. The motion can be vertical or rotational. An internal extension of the collector cone 64 or similar shielding apparatus will be situated inside the chimney 16 and protrude beyond the chimney 16 side openings 66 to ensure that the leakage fluids 44 collected by the collector 10 flow past the openings and not out of the openings. The controlled introduction of water through the side openings in the collector 10 can be used to vary the density of the fluid in the chimney 16 and thus vary the flow rate and or pressure of the leakage fluid 44 in the chimney 16 to the surface. The geometry of the openings can be optimized as required.

Figure 3A:
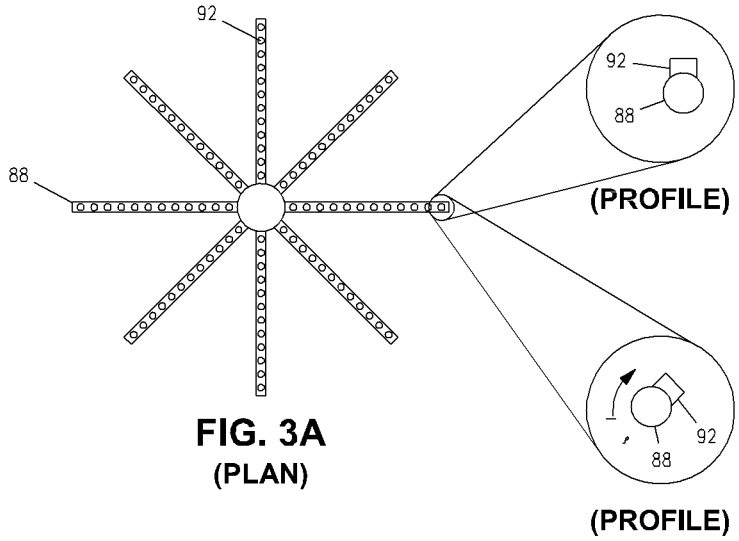
FIG. 3A is a plan view of the priming/de-coalescing wand.
Figure 3:
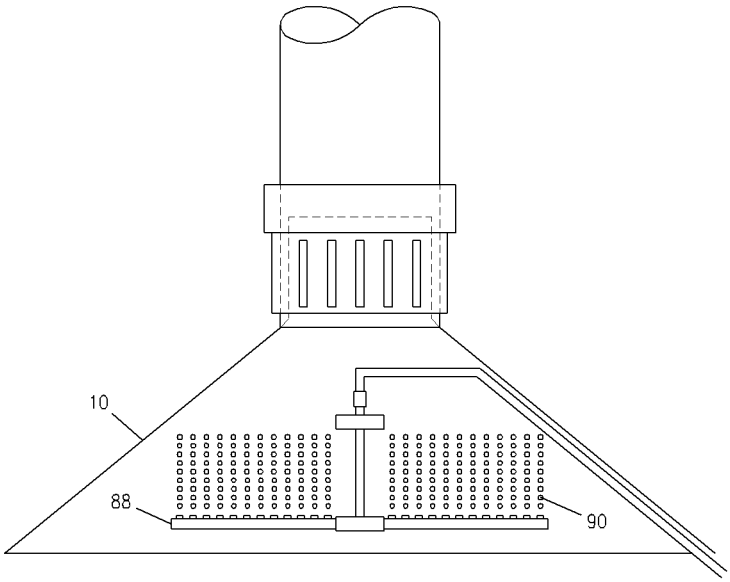
FIG. 3 is a view of a priming/de-coalescing wand.
Figure 4:
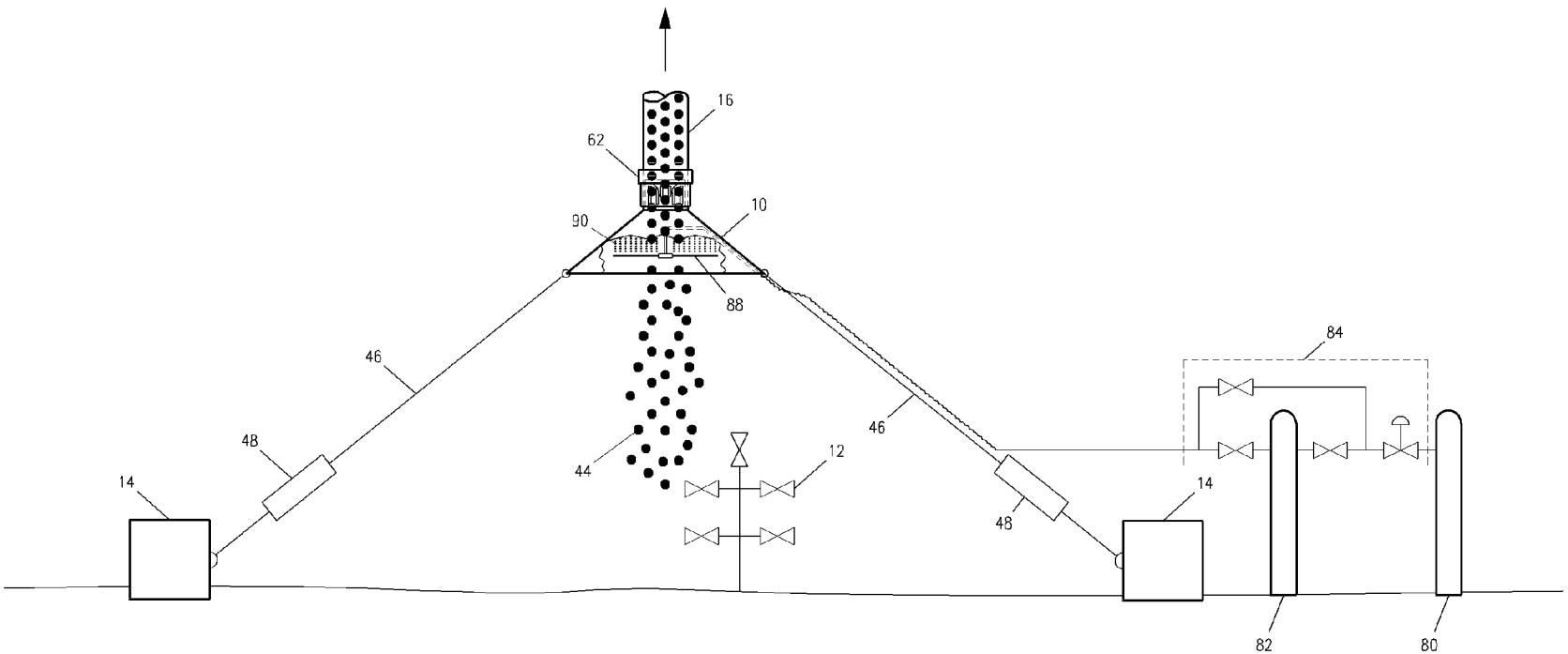
FIG. 4 is a view of collector inlet details according to an embodiment.

Another additional improvement in the way of priming/de-coalescing the fluid is described as follows and shown in FIG. 3. In this embodiment, a source of a hydrate dissipating medium is used that is below, in or attached to the hydrocarbon fluid collector 10 or in or attached to the conduit for preventing hydrate formation or dissipating hydrate that has formed. The collector 10 may thus include a priming/de-coalescing wand 88 for introducing small gas (e.g. nitrogen) bubbles 90 as a hydrate dissipating medium supplied from a high pressure source (e.g. gas bottles 80 via the hose 86 into the chimney 16). Effectively introducing a significantly lower density fluid (e.g. nitrogen gas) into the water column in the chimney 16 will quickly lower the density of the water column and initiate and/or enhance the conveyance of the leaking fluid 44 up the chimney 16 thereby initiating the self sustaining flow. The priming/de-coalescing wand 88 can be designed so that the gas bubbles 90 are of the optimum size to de-coalesce the leaking fluid 44. By interacting with the globules of leaking fluid 44, the gas bubbles 90 can cause the globules to break-up and decrease in size, which will assist in the migration of the leaking fluid 44 up through water column in the chimney 16 and further expedite the lowering of the density of the water column in the chimney 16 and initiate the conveyance of the leaking fluid 44 up through the chimney 16. The priming/de-coalescing wand 88 can also be designed so that the gas bubbles 90 are of varying size: one size to optimize de-coalescing the leaking fluid 44 and another for quickly lowering the density of the water column in the chimney 16. The priming/de-coalescing wand 88 can be made to rotate by adjusting the orientation of the gas nozzles 92 to cause a sideways thrust. Rotating the priming/de-coalescing wand 88 as the leaking fluid 44 passes by can further de-coalesce the leaking fluid 44.

An additional embodiment of a hydrate dissipating medium is the introduction of a surfactant or other chemicals 82 via a hose 86 through the priming/de-coalescing wand 88 to further enhance the recovery of the leaking fluid 44. A further embodiment of a hydrate dissipating medium is the use of heated fluids created by installing a heater below, in or attached to the hydrocarbon fluid collector or the conduit.

The gas and surfactant bottles 80 and 82 as sources for compressed gas and surfactant can be replaced with other sources, as required. For example hoses from the surface facilities could supply the gas and surfactant.

The basis upon which the self sustaining flow phenomena occurs is based on the following equations which state that a pressure differential or fluid head is achievable when fluids of different densities can be isolated and allowed to interact through the apparatus described herein.

Calculations $$\Delta P = (\rho_{water} * g * h_{water}) - (\rho_{fluid} * g * h_{fluid})$$

$$h_{fluid} = \frac{P}{\rho_{fluid} * g}$$

Where;

$\Delta P$=pressure differential (kPa)

$\rho_{water}$=density of water (kg/m$^3$)

$\rho_{fluid}$=density of fluid (kg/m$^3$)

g=gravity (9.81 m/sec$^2$)

$h_{water}$=height of water column (m)

$h_{fluid}$=height of fluid column (m)

Figure 5:
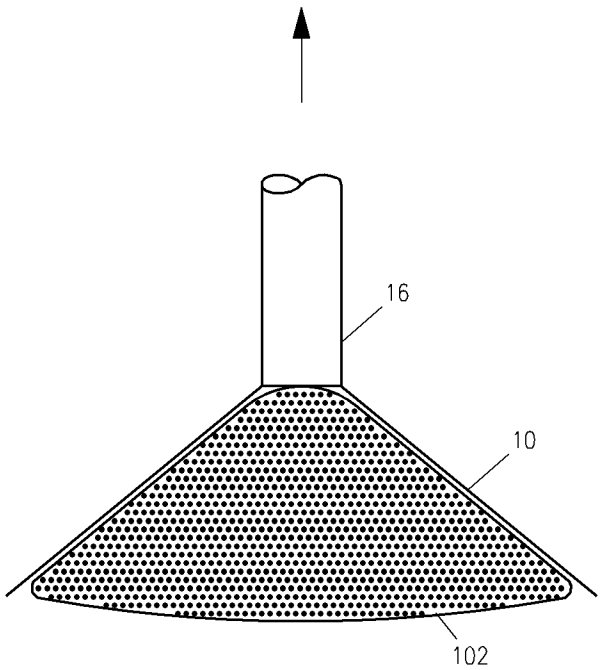
FIG. 5 is a cut-away side view of a gel plug in the collector.

An improvement to the collector is shown in FIG. 5. To prevent hydrates, sea-life, or other accumulations from partially or fully obstructing the chimney 16 prior to initiation of the leaking fluid recovery process, when the submerged hydrocarbon recovery apparatus is in standby mode a removable physical barrier may be placed in or attached to the hydrocarbon fluid collector 10 for preventing blockages in the hydrocarbon fluid collector. One example of a removal physical barrier is a gel plug 102 that may be placed in the collector 10. The gel plug 102 may be dislodged prior to initiating the recovery of the leaking fluid 44 by filling the chimney 16 from the surface with high pressure gas (e.g. nitrogen) to the point that the gel plug 102 is pushed out of the collector 10, or is otherwise dispersed. Alternatively, the gel plug 102 may be conveyed up through the chimney 16 together with the recovered leaking fluid.

Figure 6:
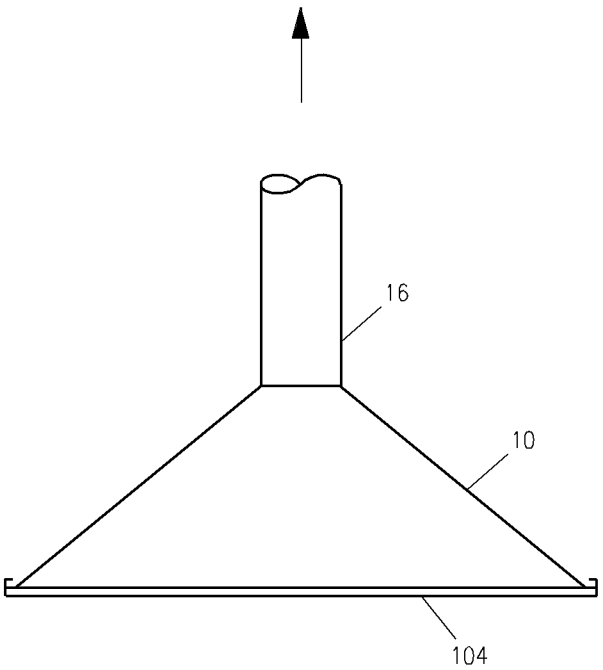
FIG. 6 is a side view of a removable bottom cover.

Another improvement to the collector 10 is shown in FIG. 6. For the same reasons of undesirable accumulations as described above, to provide a removable physical barrier a removable bottom cover 104 may be fixed to the collector 10 until the submerged hydrocarbon recovery apparatus is ready to collect and convey the leaking fluid 44. The removable bottom cover 104 may be removed prior to initiating the recovery of the leaking fluid 44 by a remotely controlled operated vehicle (ROV) or dislodged by filling the chimney 16 from the surface with high pressure gas (e.g. nitrogen) to the point that the removable bottom cover 104 is pushed away from the collector 10.

Figure 7:
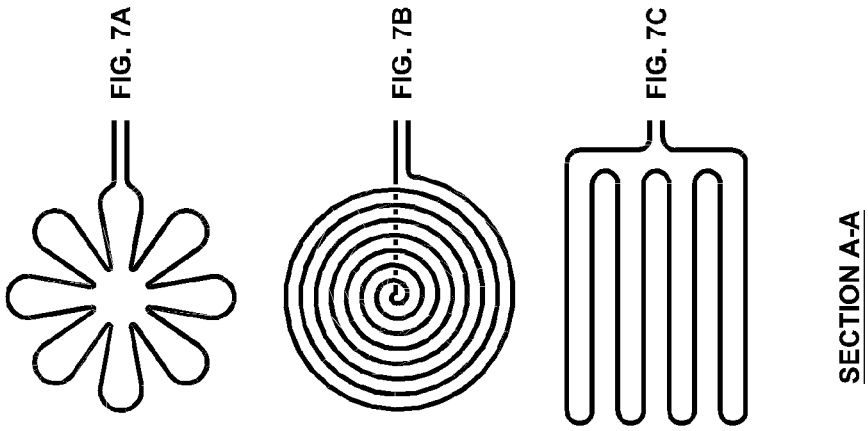
FIG. 7 is a side view of a electric heating modules attached to the collector.
Figure 7:
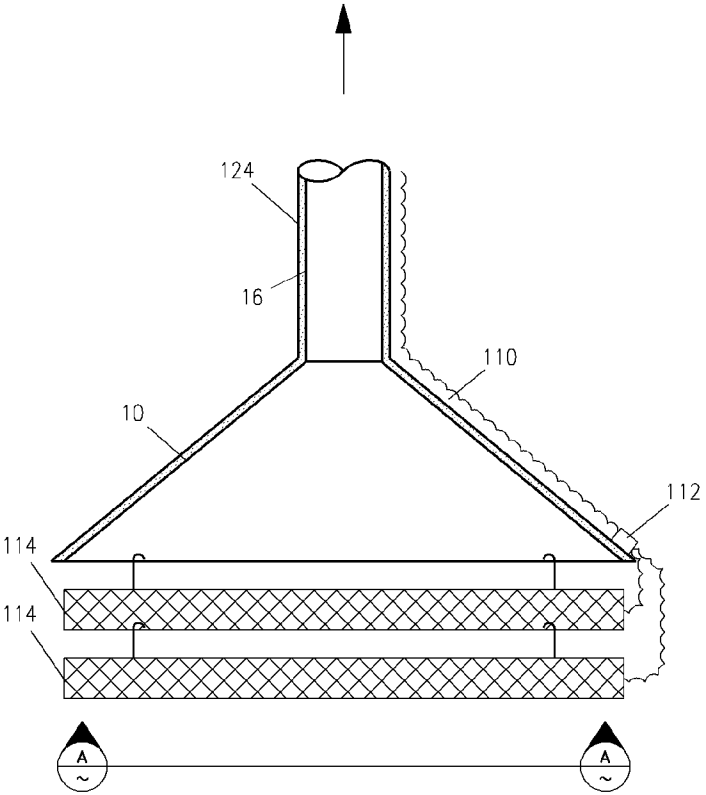

At low temperatures, moderate to high pressures, and in the presence of water, hydrocarbon fluids may form hydrates (also know as gas clathrates) that may accumulate in the collector 10 and partially or fully obstruct the collector 10, chimney 16, or both. The application of methanol or other chemicals through the priming/de-coalescing wand 88 may help prevent or eliminate hydrates. Besides adding chemicals, hydrate formation can be prevented by the application of heat to raise the temperature of the hydrocarbon fluid above the hydrate formation temperature. Therefore an improvement to the apparatus is shown in FIG. 7, wherein a modular electric heating element or plurality of electric heating elements 114 may be added below or inside the collector 10. Each element 114 may be plugged into an optional coupling 112 located in the vicinity or powered directly from the surface via a dedicated power cable 110. The optional coupling 112 could be configured to accept a plurality of connections from electric heating elements 114. The amount of power applied to the electric heating element(s) 114 can be controlled to regulate the amount of heat applied to the fluids being recovered. FIGS. 7A, 7B and 7C illustrate various patterns that could be used for the electric heating elements 114, though the patterns shown are examples only and not intended to limit the possibilities. Insulation 124 may be installed on the outside of the chimney 16 and/or collector 10 and extend the full length of the chimney 16 and/or collector 10 to decrease the loss of heat to the surrounding water.

An alternative or additional improvement to the apparatus is shown in FIG. 8 wherein an external electric heating element 120 or plurality thereof, is located on the outside of the chimney 16 for the full or partial length of the chimney 16. The electric heating element(s) 120 may be powered from the surface. Insulation 124 may be installed on the outside of the chimney 16 and/or collector 10 and extend the full length of the chimney 16 and/or collector 10 to decrease the loss of heat to the surrounding water.

An alternative or additional improvement to the apparatus is shown in FIG. 8 wherein an internal electric heating element 122 or plurality thereof, is located inside the chimney 16 for the full or partial length of the chimney 16. The electric heating element(s) 122 may be powered from the surface. Insulation 124 may be installed on the outside of the chimney 16 and/or collector 10 and extend the full length of the chimney 16 and/or collector 10 to decrease the loss of heat to the surrounding water.

An improvement to the apparatus is shown in FIG. 9. A perforated tube 130 or system of perforated tubes is inserted inside the chimney 16 for the full or partial height of the chimney 16 for injection of chemicals 132 (e.g. methanol for hydrate prevention/elimination, chemicals to enhance the chimney 16 flow, or chemicals to unplug the chimney).

Figure 10:
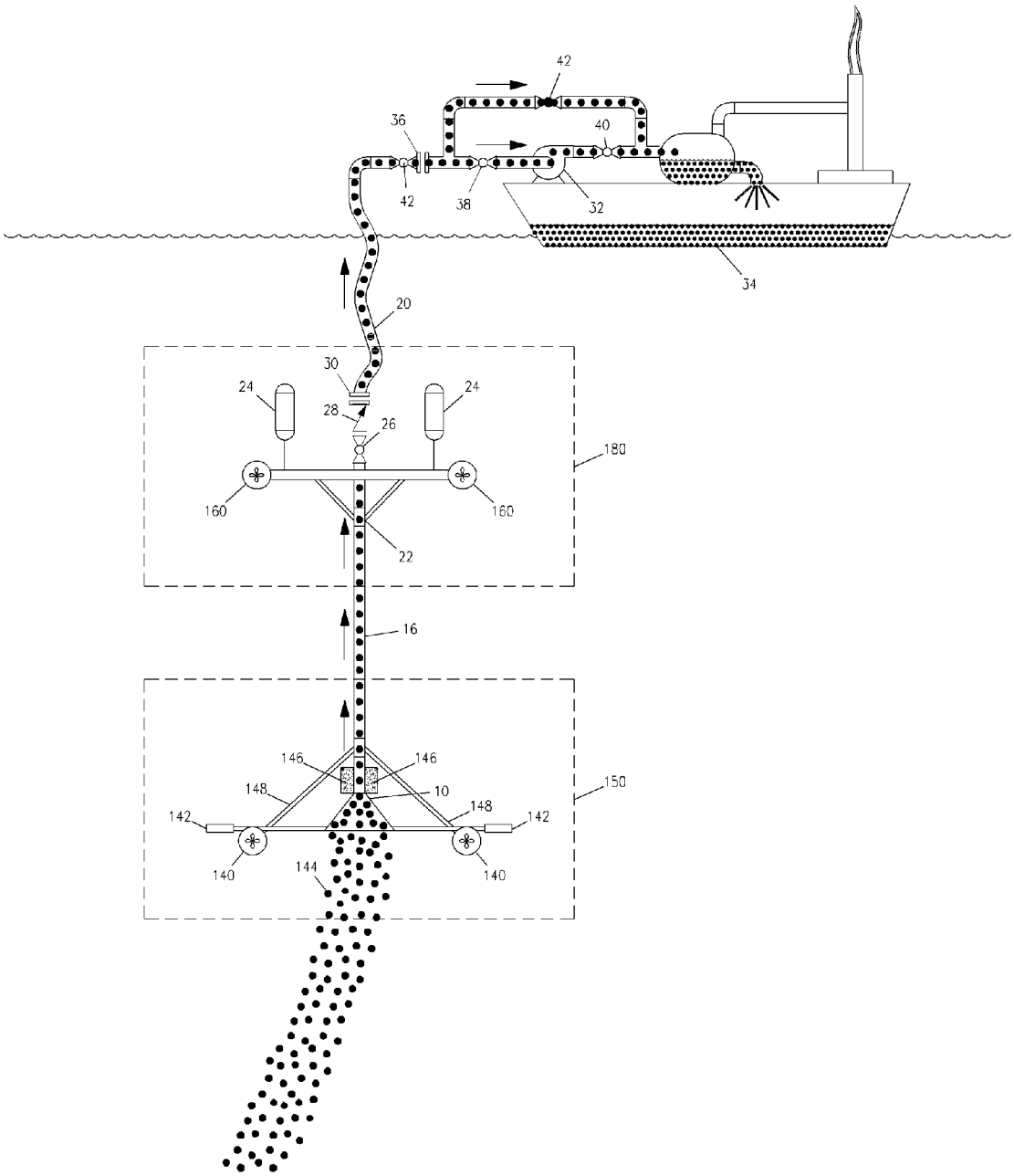
FIG. 10 is a side view of a mobile submerged hydrocarbon recovery apparatus.

Referring to FIG. 10, another embodiment of the submerged hydrocarbon recovery apparatus is to replace the anchor system 14, 46 and 48 with thruster mechanisms 140 attached to the collector assembly 150. Additional thruster mechanisms 160 may be attached to a mobile flotation assembly 180. In this embodiment, the length (depth) of the chimney 16 may be shortened significantly as the submerged hydrocarbon recovery apparatus no longer has to be placed directly above the leakage source. The now mobile submerged hydrocarbon recovery apparatus can position the collector assembly 150 above the leaking fluid plume 144 at a depth closer to the surface. The thruster mechanisms 140 and 160 together with optional detection sensors 142 placed around, at or near the collector 10 will allow the collector assembly 150 to track and maintain position above the leak plume 144 to ensure that the leaking fluid is captured and conveyed to the surface for recovery. The detection sensors 142 will detect varying concentrations of the leaking fluid (e.g. hydrocarbons) and may be utilized to track leak plume 144 movement. The detection sensors 142 will provide feedback to a control system for the thruster mechanisms 140 and 160. The control system for the thruster mechanisms 140 and 160 may be located on a service vessel on the surface, as required. Global positioning systems may also be used to assist the submerged hydrocarbon recovery apparatus in maintaining its position above the leak plume 144. The mouth size of the collector 10 may be increased, as required. The collector assembly 150 will be sufficiently weighted 146 to keep the submerged hydrocarbon recovery apparatus vertically oriented, as required. The final length and pressure rating of the chimney 16 will be determined based upon the pressure (hydraulic head) required to raise the recovered fluid up and into a service vessel or tanker 34 on the surface or at the depth at which a significant and sudden change in water density occurs (e.g. at a significant thermocline) which may act to disperse the leak plume 144. Since the amount of pressure required to recover leakage fluid 44 is a function of the chimney 16 length (i.e. height) then the shorter the chimney 16 the lower the required design pressure rating of the chimney. Shallower placement of the collector assembly 150 (i.e. shortening of the chimney 16) will also result in a decrease in the ambient pressure of the leaking fluid 44 and an increase in water temperature (as surface water is warmer), both of which can significantly reduce the likelihood of hydrate formation. With lower design pressure requirements, the chimney 16 may be constructed with low pressure flexible, collapsible, or coil-able piping or ducting making it easier to deploy. The mobile flotation assembly 180 may still be located sub surface (below the influence of surface waves) so that the submerged hydrocarbon recovery apparatus can remain essentially stationary in the water and not be affected by wave action (or it may be designed to float on the surface, as required). The mobile flotation assembly 180 will essentially be as previously described but may have the addition of thruster mechanisms 160 to work in conjunction with the thruster mechanisms 140 located at the collector assembly 150 to maintain the chimney 16 in the vertical or near vertical position and thereby enhance the recovery capability of the submerged hydrocarbon recovery apparatus. The now significantly shorter submerged hydrocarbon recovery apparatus will be easier to deploy, may not require deep diving remotely operated vehicles to deploy, and may be launched more easily from a service vessel. The operating principle of the shortened chimney 16 is the same as that described previously for the anchored submerged hydrocarbon recovery apparatus.

Figure 11:
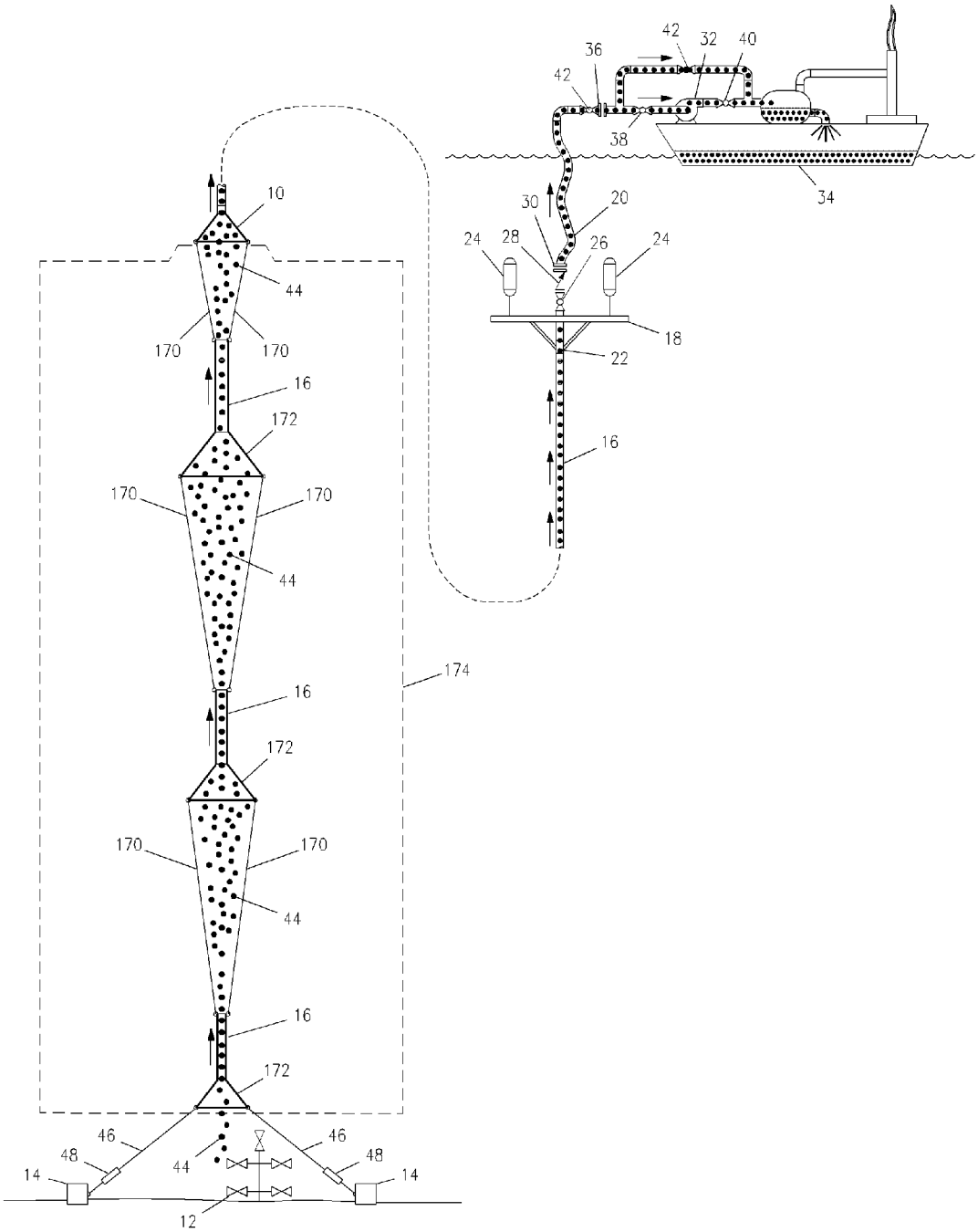
FIG. 11 is a side view of an intermediate collector apparatus and submerged hydrocarbon recovery apparatus.

In another embodiment shown in FIG. 11, an intermediate collector apparatus 174 comprised of a series of intermediate collectors 172 complete with chimneys 16 and connected to each other by cables 170, or similar, may be suspended between the leakage source 12 and the anchored submerged hydrocarbon recovery apparatus. The intermediate collectors 172 form a chain of plume concentrators disposed between the underwater hydrocarbon leak and the hydrocarbon fluid collector 10. The chain of plume concentrators collimates the plume of fluids emanating from the underwater hydrocarbon leak. The topmost intermediate collector 172 or chimney 16 thereof may be attached to the anchored submerged hydrocarbon recovery collector 10, as shown in FIG. 11 and thereby employ the flotation assembly 18 and anchoring system 14, 46, and 48 employed by the anchored submerged hydrocarbon recovery apparatus. As the leakage fluid 44 rises up from the leakage source 12 the cross-sectional area of the resulting plume will typically increase in size due to dispersion and/or expansion. Each intermediate collector 172 serves to gather the leakage fluid 44 and re-focus it into a much smaller cross-sectional area, whereupon it is released to rise once again to be gathered and re-focused by a subsequent intermediate collector 172 to be eventually captured by the hydrocarbon recovery apparatus collector 10 and conveyed to the vessel 34 as described in previous embodiments. By using intermediate collectors 172, the pressure of the leakage fluid 44 equalizes with the surrounding water at the exit point of each intermediate collector chimney 16 which reduces the final pressure of the leakage fluid 44 to a more manageable level.

Figure 12:
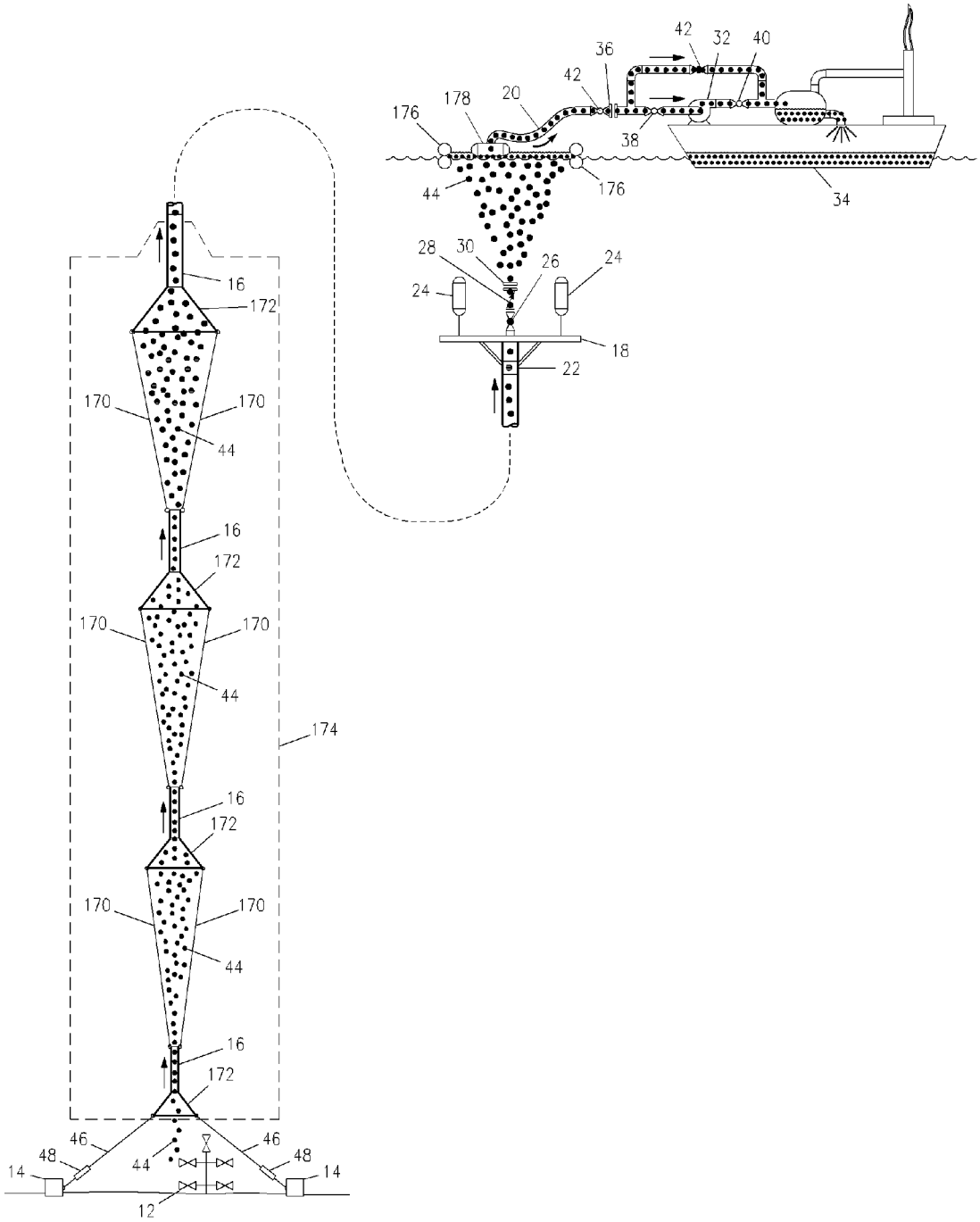
FIG. 12 is a side view of an intermediate collector apparatus, surface containment boom and skimmer.

In another embodiment shown in FIG. 12, the topmost intermediate collector 172 may be supported by an independent collector flotation assembly 18 located near the surface at a depth not affected by surface disturbances (i.e. waves, tide, etc). In this embodiment, the recovered leakage fluid 44 is released from the chimney 16 outlet of the topmost intermediate collector 172 to freely rise to the surface where it may be confined by conventional spill containment booms 176 and reclaimed with conventional skimming systems 178. The chimney 16 outlet of the topmost intermediate collector 172 may extend to the surface to further limit the size of the surface plume area, as required. The series of intermediate collectors 172 may be connected to each other by cables 170, or similar and/or directly to an anchoring system 14, 46, and 48 similar to that described previously for the anchored submerged hydrocarbon recovery apparatus. The anchoring system(s) 14, 46, and 48 for the intermediate collectors 172 may be shared with each other or be independent The topmost intermediate collector 172 may terminate with a shutoff valve 26, check valve 28, and/or connection coupling 30 which may be coupled to a flexible hose 20 which may be connected to a surface vessel 34 with or without a pump 32 (e.g. multiphase) for final recovery of the leakage fluid 44, as described previously for the anchored submerged hydrocarbon recovery apparatus or mobile version thereof.

Figure 13:
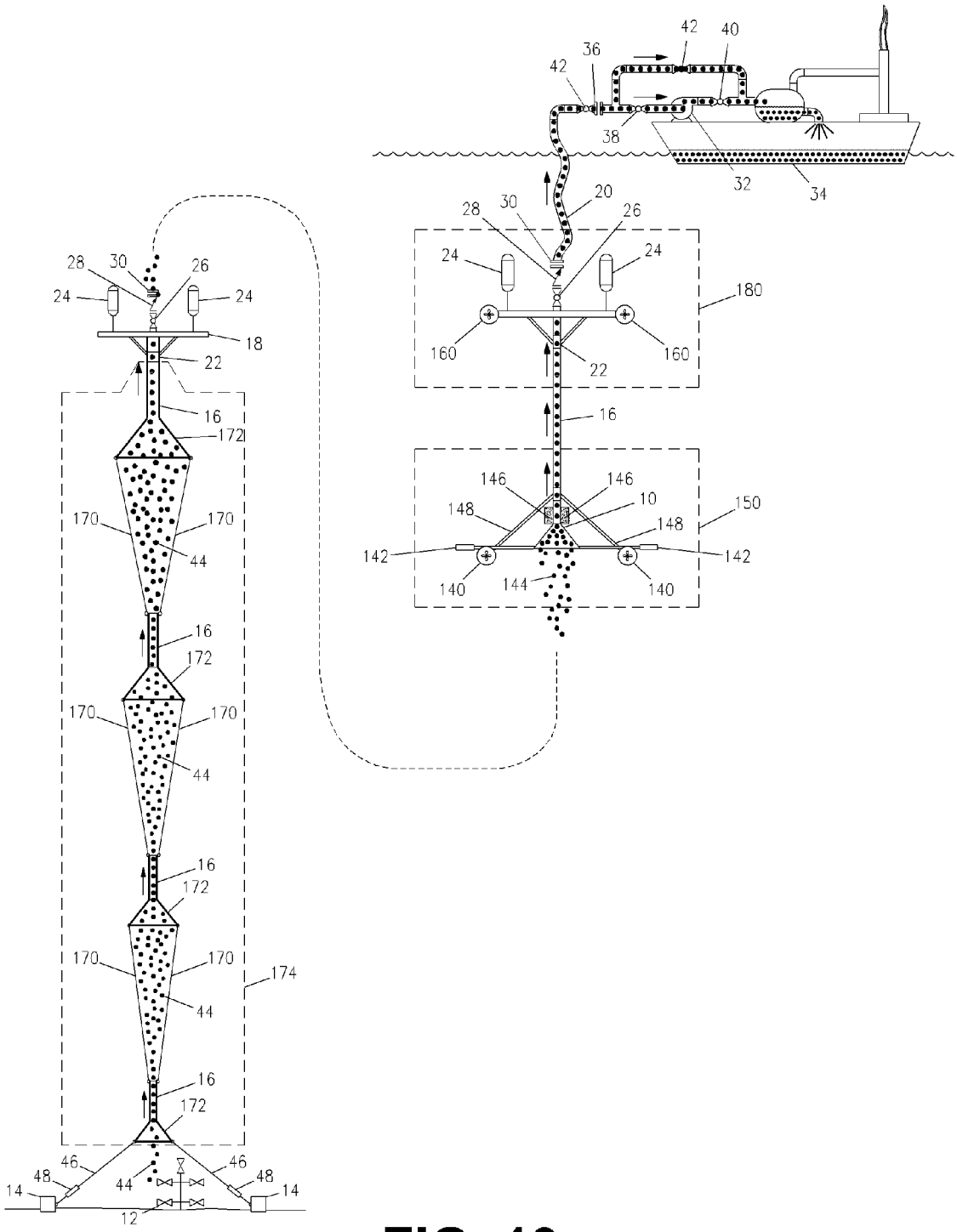
FIG. 13 is a side view of an intermediate collector apparatus and mobile submerged hydrocarbon recovery apparatus.

In another embodiment shown in FIG. 13, the mobile submerged hydrocarbon recovery collector 150 may be positioned over or attached to the flotation assembly 18 which in turn is attached to the topmost intermediate collector 172. The intermediate collector apparatus 174 may be held in place by cables 46 attached at one end to anchors 14 that may include devices 48 for remotely (or otherwise) shortening/lengthening the anchor lines, as required. The series of intermediate collectors 172 may be connected to each other by cables 170, or similar and/or directly to an anchoring system 14, 46, and 48 similar to that described previously for the anchored submerged hydrocarbon recovery apparatus. The anchoring system(s) 14, 46, and 48 for the intermediate collectors 172 may be shared with each other or be independent.

The quantity and distance between intermediate collectors 172 utilized may depend upon the leakage fluid 44 flow rate, the depth of the leak source 12 from the surface, the amount of the gas present in the leakage fluid 44, the velocity of the cross and upwelling currents, the length of the chimney 16 portion of the intermediate collector 172, and/or the diameter of the conical portion of the intermediate collector 172, etc. The more gas (expandable) fluid there is, the greater number of intermediate collectors 172 required, and/or the shorter the intervals between intermediate collectors 172 possible.

The chimney 16 portion of the intermediate collector 172 may be lengthened to enhance the fluid velocity, as required. The actual geometry (diameter and slope of intermediate collector 172, diameter and/or length of chimney 16, etc.) of each successive intermediate collector 172 may vary, as required. The intermediate collector 172 conical portion may have a hydrodynamic shape (cross section) to improve the stability of the intermediate collector apparatus 174 in cross-currents that may occur in the water body.

The intermediate collector apparatus 174 will confine the leakage fluid 44 plume to a specific area and prevent it from dispersing over what would typically be a much larger area. The intermediate collector apparatus 174 could be quickly deployed in the event of a subsurface leak incident and would be compact to store as each intermediate collector 172 could be stacked on top of the other and thereby occupy minimal storage space.

Heating, chemicals, and/or high pressure gas may be introduced at each intermediate collector 172, as described previously for the anchored submerged hydrocarbon recovery apparatus collector 10 and chimney 16. It is understood that the intermediate collector apparatus 174 may transport the leakage fluid 44 to a depth at which hydrates can no longer form (due to lower water pressure and/or higher water temperature) prior to collection by the anchored submerged hydrocarbon recovery apparatus or mobile version thereof, greatly reducing or eliminating the need for hydrate control systems (such as heat or chemical application. Opportunities for hydrates to build up and restrict and/or block flow as the leakage fluid 44 rises to the surface may be prevented since the leakage fluid 44 is mostly unconfined as it rises through the intermediate collector apparatus 174.

In order to initially establish the leakage fluid 44 flow through the intermediate collector apparatus 174, high pressure gas may be injected into the mouth of the first (i.e. bottommost) intermediate collector 172 located above the leakage source 12. Injecting high pressure gas at this point will generate gas bubbles that will travel up the chimney 16 portion of the intermediate collector 172 and thereby induce flow through the chimney 16 which will expedite the transport of the leakage fluid 44 up through the intermediate collector 172. Gas bubbles leaving the first intermediate collector 172 will be captured by the next intermediate collector 172 (and so on) and will thereby continue to induce the flow of leakage fluid 44 through subsequent intermediate collectors 172 until fluid flow has been established through the entire intermediate collector apparatus 174 and any associated hydrocarbon recovery apparatus. Alternatively, high pressure gas may be injected directly into the mouth of any or all of the intermediate collectors 172 in the series, as required.

An embodiment of the mobile submerged hydrocarbon recovery apparatus and the anchored submerged hydrocarbon recovery apparatus may comprise a number of components, as shown in FIG. 1A. In order to initially establish the preferred flow regime for the leakage fluid 44 through the apparatus, the chimney 16, collector 10 and flotation assembly 18 in both the mobile submerged hydrocarbon recovery apparatus and the anchored submerged hydrocarbon recovery apparatus may be replaced by multiple chimneys 182 with varying diameters for conveying the leakage fluid 44 from a matching multiple outlet collector 184 to a multi chimney flotation assembly 190 located at a depth not affected by surface disturbances (i.e. waves, tide, etc), and finally to the flexible high pressure conduit 20 to transport the fluid from the multi chimney flotation assembly 190 through the back pressure/flow control/bypass valve 42 located on a floating platform, barge or vessel 34. Each chimney 182 forms a conduit extending from the hydrocarbon fluid collector 10 and is in fluid communication with the flotation assembly 18 for supply of collected fluids from the hydrocarbon fluid collector 10 to the flotation assembly 18. The hydrocarbon fluid collector 10 is configured to convey to each of the plural conduits 182 an undifferentiated portion of the fluids emanating from the underwater hydrocarbon leak.

Each chimney 182 may terminate with a shut off valve 186 prior to connection with a manifold 188. The manifold 188 may include a shutoff valve 26, a backflow check valve 28 and a connection coupling 30 in order to facilitate the isolation and disconnection of the top portion of the manifold 188 from the surface facilities above.

The apparatus and methods of the present disclosure are also described in the following paragraphs.

Apparatus for underwater hydrocarbon fluid spill containment, comprising: a hydrocarbon fluid collector having an opening for receiving and collecting fluids emanating from an underwater hydrocarbon leak; a flotation assembly; a conduit extending between the hydrocarbon fluid collector and the flotation assembly for supply of collected fluids from the hydrocarbon fluid collector to the flotation assembly; and the hydrocarbon fluid collector disposed over the underwater hydrocarbon leak, with the hydrocarbon fluid collector being freely suspended over the underwater hydrocarbon leak, without positioning cables and without being anchored.

The apparatus as described further comprising thrusters on the hydrocarbon fluid connector for lateral or vertical positioning or both lateral and vertical positioning of the hydrocarbon fluid connector.

Apparatus for underwater hydrocarbon fluid spill containment, comprising: a hydrocarbon fluid collector having an opening for receiving and collecting fluids comprising at least liquids and gases emanating from an underwater hydrocarbon leak; a flotation assembly for supply of collected fluids from the hydrocarbon fluid collector to the flotation assembly; a conduit extending between the hydrocarbon fluid collector and the flotation assembly, the hydrocarbon fluid collector being configured to convey to the conduit the fluids emanating from the underwater hydrocarbon leak; and a source of de-coalescent disposed to inject de-coalescent into the hydrocarbon fluid collector or into the conduit or into both the hydrocarbon fluid collector or into the conduit.

The apparatus as described in which the de-coalescent comprises compressed gas or a surfactant or a combination of compressed gas and a surfactant.

Apparatus for underwater hydrocarbon fluid spill containment, comprising: an hydrocarbon fluid collector having an opening for receiving and collecting fluids emanating from an underwater hydrocarbon leak; a flotation assembly; a conduit extending between the hydrocarbon fluid collector and the flotation assembly for supply of collected fluids from the hydrocarbon fluid collector to the flotation assembly; and a source of compressed gas disposed to inject compressed gas into the hydrocarbon fluid collector and into the conduit.

Apparatus for underwater hydrocarbon fluid spill containment, comprising: a hydrocarbon fluid collector having an opening for receiving and collecting fluids emanating from an underwater hydrocarbon leak; a flotation assembly, the flotation assembly being submersible; a conduit extending between the hydrocarbon fluid collector and the flotation assembly for supply of collected fluids from the hydrocarbon fluid collector to the flotation assembly.

Apparatus for underwater hydrocarbon fluid spill containment, comprising: a hydrocarbon fluid collector having an opening for receiving and collecting fluids emanating from an underwater hydrocarbon leak; a flotation assembly; a conduit extending between the hydrocarbon fluid collector and the flotation assembly for supply of collected fluids from the hydrocarbon fluid collector to the flotation assembly; and means to control fluid density in the conduit comprising one or more openings in the conduit having a controllable opening size.

Apparatus for underwater hydrocarbon fluid spill containment, comprising: a hydrocarbon fluid collector having an opening for receiving and collecting fluids emanating from an underwater hydrocarbon leak; a flotation assembly; a conduit extending between the hydrocarbon fluid collector and the flotation assembly for supply of collected fluids from the hydrocarbon fluid collector to the flotation assembly; and a removable physical barrier in or attached to the hydrocarbon fluid collector for preventing blockages forming in the hydrocarbon fluid collector.

The apparatus as described which the removable physical barrier comprises a gel plug in the collector.

The apparatus as described in which the removable physical barrier comprises a removable bottom cover on the hydrocarbon fluid collector.

Apparatus for underwater hydrocarbon fluid spill containment, comprising: a hydrocarbon fluid collector having an opening for receiving and collecting fluids emanating from an underwater hydrocarbon leak; a flotation assembly; a conduit extending between the hydrocarbon fluid collector and the flotation assembly for supply of collected fluids from the hydrocarbon fluid collector to the flotation assembly; and a source of a hydrate dissipating medium below, in or attached to the hydrocarbon fluid collector or in or attached to the conduit for preventing hydrate formation or dissipating hydrate that has formed.

The apparatus as described which the source of hydrate dissipating medium is a heater or chemical source.

The apparatus as described which the source of hydrate dissipating medium is in the hydrocarbon fluid collector or the conduit.

The apparatus as described which the source of hydrate dissipating medium comprises a perforated tube in the hydrocarbon fluid collector or the conduit.

Apparatus for underwater hydrocarbon fluid spill containment, comprising: a hydrocarbon fluid collector having an opening for receiving and collecting fluids emanating in a plume from an underwater hydrocarbon leak; a flotation assembly; a conduit extending between the hydrocarbon fluid collector and the flotation assembly for supply of collected fluids from the hydrocarbon fluid collector to the flotation assembly; and the hydrocarbon fluid collector disposed over the underwater hydrocarbon leak, with a chain of plume concentrators disposed between the underwater hydrocarbon leak and the hydrocarbon fluid collector, the chain of plume concentrators collimating the plume of fluids emanating from the underwater hydrocarbon leak.

Apparatus for underwater hydrocarbon fluid spill containment, comprising: a hydrocarbon fluid collector having an opening for receiving and collecting fluids comprising at least liquids and gases emanating from an underwater hydrocarbon leak; a flotation assembly; and plural conduits, each conduit of the plural conduits extending from the hydrocarbon fluid collector and being in fluid communication with the flotation assembly for supply of collected fluids from the hydrocarbon fluid collector to the flotation assembly, the hydrocarbon fluid collector being configured to convey to each of the plural conduits an undifferentiated portion of the fluids emanating from the underwater hydrocarbon leak.

The apparatus as described above further comprising a separation facility associated with the flotation assembly and connected to receive fluid from the conduit through a surface conduit.

The apparatus as described above in which the flotation assembly comprises hydrocarbon fluid storage or a transfer facility for conveying hydrocarbons to fluid storage.

The apparatus as described above in which the conduit comprises one or more check valves.

The apparatus as described above further comprising a pump to initiate flow in the conduit.

The apparatus as described above further comprising remotely controlled length adjustable anchor lines for anchoring the hydrocarbon fluid collector.

The apparatus as described above arranged over a submerged hydrocarbon fluid leak to provide a self-sustaining flow of hydrocarbon fluid through the conduit.

The apparatus as described above further comprising thrusters attached to the flotation assembly for positioning the flotation assembly relative to the collector.

A method of protecting against an underwater spill, comprising providing a hydrocarbon fluid collector having an opening for receiving and collecting fluids emanating from an underwater hydrocarbon leak, the hydrocarbon fluid collector being freely suspended over an underwater hydrocarbon leak that is discharging fluids into water, providing a flotation assembly; and collecting fluid discharged from the underwater hydrocarbon leak by capturing the fluids with the hydrocarbon fluid collector and flowing the fluids through a conduit extending between the hydrocarbon fluid collector and the flotation assembly, the hydrocarbon fluid collector being freely suspended over the underwater hydrocarbon leak, without positioning cables and without being anchored.

The method as described further comprising adjusting lateral positioning of the hydrocarbon fluid connector by using thrusters.

A method of protecting against an underwater spill, comprising providing a hydrocarbon fluid collector having an opening for receiving and collecting fluids comprising at least liquids and gases emanating from an underwater hydrocarbon leak, the hydrocarbon fluid collector being placed over an underwater hydrocarbon leak that is discharging the fluids into water, providing a flotation assembly; collecting fluid discharged from the underwater hydrocarbon leak by capturing the fluids with the hydrocarbon fluid collector and flowing the fluids through a conduit extending between the hydrocarbon fluid collector and the flotation assembly; and injecting de-coalescent into the hydrocarbon fluid collector and into the conduit.

The method as described in which the de-coalescent comprises compressed gas or a surfactant or a combination of compressed gas and a surfactant.

A method of protecting against an underwater spill, comprising providing a hydrocarbon fluid collector having an opening for receiving and collecting fluids emanating from an underwater hydrocarbon leak, the hydrocarbon fluid collector being placed over an underwater hydrocarbon leak that is discharging fluids into water, providing a flotation assembly; collecting fluid discharged from the underwater hydrocarbon leak by capturing the fluids with the hydrocarbon fluid collector and flowing the fluids through a conduit extending between the hydrocarbon fluid collector and the flotation assembly; and injecting compressed gas into the hydrocarbon fluid collector or into the conduit or into both the hydrocarbon fluid collector or into the conduit.

A method of protecting against an underwater spill, comprising providing a hydrocarbon fluid collector having an opening for receiving and collecting fluids emanating from an underwater hydrocarbon leak, the hydrocarbon fluid collector being placed over an underwater hydrocarbon leak that is discharging fluids into water, providing a submerged flotation assembly; collecting fluid discharged from the underwater hydrocarbon leak by capturing the fluids with the hydrocarbon fluid collector and flowing the fluids through a conduit extending between the hydrocarbon fluid collector and the flotation assembly.

The method as described further comprising transferring fluids from the submerged flotation assembly to a surface vessel.

A method of protecting against an underwater spill, comprising providing a hydrocarbon fluid collector having an opening for receiving and collecting fluids emanating from an underwater hydrocarbon leak, the hydrocarbon fluid collector being placed over an underwater hydrocarbon leak that is discharging fluids into water, providing a flotation assembly; collecting fluid discharged from the underwater hydrocarbon leak by capturing the fluids with the hydrocarbon fluid collector and flowing the fluids through a conduit extending between the hydrocarbon fluid collector and the flotation assembly; and controlling fluid density in the conduit by providing one or more openings in the conduit and adjusting an opening size of the one or more openings.

A method of protecting against an underwater spill, comprising providing a hydrocarbon fluid collector having an opening for receiving and collecting fluids emanating from an underwater hydrocarbon leak, the hydrocarbon fluid collector being placed over an underwater hydrocarbon leak that is discharging fluids into water, providing a flotation assembly; collecting fluid discharged from the underwater hydrocarbon leak by capturing the fluids with the hydrocarbon fluid collector and flowing the fluids through a conduit extending between the hydrocarbon fluid collector and the flotation assembly; and preventing blockages forming in the hydrocarbon fluid collector by providing a removable physical barrier in or attached to the hydrocarbon fluid collector.

The method as described which the removable physical barrier comprises a gel plug in the collector, the gel plug being removable by remote operation of the gel plug.

The method as described which the gel plug is removable by injecting gas into the conduit.

The method as described which the removable physical barrier comprises a removable bottom cover on the hydrocarbon fluid collector.

A method of protecting against an underwater spill, comprising providing a hydrocarbon fluid collector having an opening for receiving and collecting fluids emanating from an underwater hydrocarbon leak, the hydrocarbon fluid collector being placed over an underwater hydrocarbon leak that is discharging fluids into water, providing a flotation assembly; collecting fluid discharged from the underwater hydrocarbon leak by capturing the fluids with the hydrocarbon fluid collector and flowing the fluids through a conduit extending between the hydrocarbon fluid collector and the flotation assembly; and preventing blockages forming in the hydrocarbon fluid collector by providing a hydrate dissipating medium below or in the hydrocarbon fluid collector or in the conduit for preventing hydrate formation or dissipating hydrate that has formed.

The method as described which the source of hydrate dissipating medium is a heater or chemical source.

The method as described which the source of hydrate dissipating medium is in the hydrocarbon fluid collector or the conduit.

The method as described above in which the source of hydrate dissipating medium comprises a perforated tube in the hydrocarbon fluid collector or the conduit.

A method of protecting against an underwater spill, comprising providing a hydrocarbon fluid collector having an opening for receiving and collecting fluids emanating from an underwater hydrocarbon leak, the hydrocarbon fluid collector being placed over an underwater hydrocarbon leak that is discharging fluids into water, providing a flotation assembly; collecting fluid discharged from the underwater hydrocarbon leak by capturing the fluids with the hydrocarbon fluid collector and flowing the fluids through a conduit extending between the hydrocarbon fluid collector and the flotation assembly; and the hydrocarbon fluid collector being disposed over the underwater hydrocarbon leak, with a chain of plume concentrators disposed between the underwater hydrocarbon leak and the hydrocarbon fluid collector, the chain of plume concentrators collimating the plume of fluids emanating from the underwater hydrocarbon leak.

A method of protecting against an underwater spill, comprising providing a hydrocarbon fluid collector having an opening for receiving and collecting fluids comprising at least liquids and gases emanating from an underwater hydrocarbon leak, the hydrocarbon fluid collector being placed over an underwater hydrocarbon leak that is discharging fluids into water, providing a flotation assembly; and collecting fluid discharged from the underwater hydrocarbon leak by capturing the fluids with the hydrocarbon fluid collector and flowing the fluids through plural conduits, each conduit of the plural conduits extending from the hydrocarbon fluid collector and being in fluid communication with the flotation assembly, the hydrocarbon fluid collector being configured to convey to each of the plural conduits an undifferentiated portion of the fluids emanating from the underwater hydrocarbon leak.

The method as described above further comprising providing a separation facility associated with the flotation assembly and connected to receive fluid from the conduit through a surface conduit.

The method as described above in which the flotation assembly comprises hydrocarbon fluid storage or a transfer facility for conveying hydrocarbons to fluid storage.

The method as described above in which the conduit comprises one or more check valves.

The method as described above further comprising a pump to initiate flow in the conduit.

The method as described above with the hydrocarbon fluid collector arranged over a submerged hydrocarbon fluid leak to provide a self-sustaining flow of hydrocarbon fluid through the conduit.

The method as described above further comprising thrusters attached to the flotation assembly for positioning the flotation assembly relative to the collector.

The method as described above further comprising precharging the hydrocarbon fluid collector with high pressure gas.

The method as described above in which the hydrocarbon fluid collector is at least partly conical.

The method as described above in which the flotation assembly is submersed.

The method as described above further comprising controlling fluid density in the conduit.

The method as described which controlling fluid density in the conduit comprises controlling opening size of one or more openings in the conduit.

Apparatus for underwater hydrocarbon fluid spill containment, comprising: a hydrocarbon fluid collector having an opening for receiving and collecting fluids emanating from an underwater hydrocarbon leak; a flotation assembly; and a conduit extending between the hydrocarbon fluid collector and the flotation assembly.

The embodiments of the invention in which an exclusive property or privilege is claimed are defined as follows:

1. Apparatus for underwater hydrocarbon fluid spill containment, comprising:

a submerged hydrocarbon fluid collector freely suspended above at least a plume from an underwater hydrocarbon leak, having an opening for receiving and collecting fluids emanating from the underwater hydrocarbon leak in the at least a plume;

a flotation assembly positioned below surface, intermediate the surface and the submerged hydrocarbon fluid collector;

a conduit extending between the hydrocarbon fluid collector and the flotation assembly for flowing fluids collected in the hydrocarbon fluid collector to the flotation assembly, for transport to the surface; and thrusters on at least the hydrocarbon fluid collector for moving the hydrocarbon fluid collector, wherein the hydrocarbon fluid collector is freely suspended without positioning cables and without being anchored; and the thrusters move at least the hydrocarbon fluid collector laterally, vertically or both to position the at least the hydrocarbon collector with respect to the at least the plume from the underwater hydrocarbon leak.

2. The apparatus of claim 1 further comprising a hydrocarbon sensor for sensing hydrocarbons in at least the plume for directing the thrusters for positioning at least the hydrocarbon fluid collector with respect to the at least the plume.

3. The apparatus of claim 1 wherein the hydrocarbon fluids comprise at least liquids and gases and wherein the hydrocarbon fluid collector is configured to convey the hydrocarbon fluids to the conduit, the apparatus further comprising:

a source of de-coalescent disposed to inject de-coalescent into the hydrocarbon fluid collector, the conduit or both.

4. The apparatus of claim 3 wherein the de-coalescent comprises compressed gas, a surfactant or combinations thereof.

5. The apparatus of claim 1 further comprising:

one or more openings in the conduit, the one or more openings having an adjustable opening size for controlling introduction of water therein or withdrawal of fluids therefrom, for varying fluid density in the conduit.

6. The apparatus of claim 1 wherein the hydrocarbon fluid collector further comprises;

a chain of plume concentrators disposed between the underwater hydrocarbon leak and the hydrocarbon fluid collector, the chain of plume concentrators collimating the plume of fluids emanating from the underwater hydrocarbon leak.

7. The apparatus of claim 6 wherein the chain of plume concentrators increase in size from a smallest concentrator adjacent the leak to a largest topmost concentrator adjacent the hydrocarbon collector.

8. Apparatus for underwater hydrocarbon fluid spill containment, comprising:

a submerged hydrocarbon fluid collector, freely suspended above an underwater hydrocarbon leak, the collector having an opening for receiving and collecting fluids from at least a plume of discharged fluids emanating from the underwater hydrocarbon leak, the collector being moveable therewith;

a flotation assembly positioned below surface, intermediate the surface and the hydrocarbon collector;

a conduit extending between the hydrocarbon fluid collector and the flotation assembly for flowing fluids collected in the hydrocarbon fluid collector to the flotation assembly, for transport to the surface; and a source of a hydrate dissipating medium within or below the hydrocarbon fluid collector or the conduit or both and immersed in the fluids therein for preventing hydrate formation or for dissipating hydrate, if formed therein.

9. The apparatus of claim 8 wherein the source of hydrate dissipating medium is a heater or a chemical source.

10. The apparatus of claim 9 wherein the source of hydrate dissipating medium is immersed within the fluid in the hydrocarbon fluid collector or in the conduit.

11. The apparatus of claim 9 wherein the source of hydrate dissipating medium is a chemical source, the apparatus further comprises:

a perforated tube in the hydrocarbon fluid collector or in the conduit for introducing the chemical therein.

12. The apparatus of claim 8 wherein the fluids are emanating in a plume from the underwater hydrocarbon leak, the hydrocarbon fluid collector further comprising;

a chain of plume concentrators disposed between the underwater hydrocarbon leak and the hydrocarbon fluid collector, the chain of plume concentrators collimating the plume of fluids emanating from the underwater hydrocarbon leak.

13. The apparatus of claim 12 wherein the chain of plume concentrators increase in size from a smallest concentrator adjacent the leak to a largest topmost concentrator adjacent the flotation assembly.

14. The apparatus of claim 8 further comprising thrusters attached to at least the flotation assembly for positioning at least the flotation assembly relative to the hydrocarbon fluid collector.

15. Apparatus for underwater hydrocarbon fluid spill containment comprising:

a submerged hydrocarbon fluid collector disposed over an underwater hydrocarbon leak, having an opening for receiving and collecting fluids emanating from the underwater hydrocarbon leak;

a flotation assembly below surface;

a conduit extending between the hydrocarbon fluid collector and the flotation assembly for flowing fluids collected in the hydrocarbon fluid collector to the flotation assembly, for transport to the surface; and a source of surfactant disposed to inject surfactant into the hydrocarbon fluid collector, the conduit or both, wherein the hydrocarbon fluids comprise at least liquids and gases and wherein the hydrocarbon fluid collector is configured to convey the hydrocarbon fluids to the conduit.

16. Apparatus for underwater hydrocarbon fluid spill containment, comprising:

a submerged hydrocarbon fluid collector freely suspended over at least a plume emanating from an underwater hydrocarbon leak and moveable therewith, the collector having an opening for receiving and collecting fluids from at least the plume;

a flotation assembly below surface, intermediate the surface and the hydrocarbon collector;

a conduit extending between the hydrocarbon fluid collector and the flotation assembly for flowing fluids collected in the hydrocarbon fluid collector to the flotation assembly, for transport to the surface; and one or more openings in the conduit, the one or more openings having an adjustable opening size for controlling introduction of water therein or withdrawal of fluids therefrom, for varying fluid density in the conduit for controlling a rate of flow therein.

17. Apparatus for underwater hydrocarbon fluid spill containment, comprising:

a submerged hydrocarbon fluid collector disposed over an underwater hydrocarbon leak, having an opening for receiving and collecting fluids emanating in a plume from the underwater hydrocarbon leak; and a chain of plume concentrators disposed between the underwater hydrocarbon leak and the hydrocarbon fluid collector, the chain of plume concentrators collimating the plume of fluids emanating from the underwater hydrocarbon leak;

a flotation assembly at or below surface; and a conduit extending between the hydrocarbon fluid collector and the flotation assembly for flowing fluids collected in the hydrocarbon fluid collector to the flotation assembly, for transport to the surface, wherein the chain of plume concentrators increase in size from smallest adjacent the leak to largest adjacent the flotation assembly.

18. A method for containing an underwater spill, comprising freely suspending a hydrocarbon fluid collector from a flotation assembly positioned at or below surface, the flotation assembly positioned intermediate the surface and the collector for moveably positioning the hydrocarbon fluid collector above at least a plume emanating from an underwater hydrocarbon leak discharging fluids;

positioning the hydrocarbon collector laterally and or vertically with respect to the at least the plume emanating from the underwater hydrocarbon leak using thrusters on at least the hydrocarbon fluid collector;

collecting the fluid discharged from the underwater hydrocarbon leak with the hydrocarbon fluid collector; and flowing the hydrocarbon fluids through a conduit extending between the hydrocarbon fluid collector and the flotation assembly.

19. The method of claim 18 further comprising:

detecting hydrocarbons using hydrocarbon sensors; and controlling the thrusters for positioning at least the hydrocarbon fluid collector with respect to the detected hydrocarbons from at least the plume emanating from the underwater hydrocarbon leak.

20. The method of claim 18 wherein the hydrocarbon fluids comprise at least liquids and gases, the method further comprising:

injecting de-coalescent into the hydrocarbon fluid collector, the conduit or both.

21. The method of claim 20 wherein the de-coalescent comprises compressed gas, a surfactant or combinations thereof.

22. The method of claim 18 further comprising:

varying the fluid density of hydrocarbons flowing through the conduit.

23. The method of claim 22 further comprising:

adjusting the size of one or more openings in the conduit for controlling the introduction of water to the conduit or the withdrawal of fluids from the conduit for varying the fluid density therein.

24. The method of claim 18 further comprising:

disposing a series of intermediate hydrocarbon fluid collectors to form a chain of plume concentrators between the underwater hydrocarbon leak and the hydrocarbon fluid collector, each plume concentrator gathering fluid; and refocusing the fluid to a smaller cross-sectional area to rise in a plume to a next plume concentrator.

25. The method of claim 24 further comprising:

increasing a size of the plume concentrators from smallest adjacent the leak to largest adjacent the flotation assembly.

26. A method for containing an underwater spill, comprising freely suspending a hydrocarbon fluid collector from a flotation assembly below surface for moving the hydrocarbon fluid collector over at least a plume of discharged fluids emanating from an underwater hydrocarbon leak;

collecting the fluid discharged from the at least plume with the hydrocarbon fluid collector;

flowing the hydrocarbon fluids through a conduit extending between the hydrocarbon fluid collector and the flotation assembly; and preventing hydrate formation or dissipating hydrate, if formed, in the hydrocarbon fluid collector or the conduit or both.

27. The method of claim 26 wherein preventing hydrate formation or dissipating hydrate further comprises:

directly heating the fluids in the hydrocarbon fluid collector or the conduit or both.

28. The method of claim 26 wherein preventing hydrate formation or dissipating hydrate further comprises:

introducing hydrate-dissipating chemical to the fluids in the hydrocarbon fluid collector or the conduit or both.

29. The method of claim 28 further comprising:

operatively connecting a perforated tube in the hydrocarbon fluid collector or in the conduit to a chemical source for introducing the hydrate-dissipating chemical to the fluids therein.

30. The method of claim 26 further comprising:

disposing a series of intermediate hydrocarbon fluid collectors to form a chain of plume concentrators between the underwater hydrocarbon leak and the hydrocarbon fluid collector, each plume concentrator gathering fluid; and refocusing the fluid to a smaller cross-sectional area to rise in a plume to a next plume concentrator.

31. The method of claim 26 further comprising:

positioning the flotation assembly relative to the hydrocarbon fluid collector using thrusters attached to at least the flotation assembly.

32. A method of containing an underwater spill, comprising:

freely suspending a hydrocarbon fluid collector from a flotation assembly below surface for positioning the hydrocarbon fluid collector over an underwater hydrocarbon leak discharging fluids;

collecting the fluid discharged from the underwater hydrocarbon leak with the hydrocarbon fluid collector;

flowing the hydrocarbon fluids through a conduit extending between the hydrocarbon fluid collector and the flotation assembly; and injecting surfactant into the hydrocarbon fluid collector, the conduit or both.

33. A method of containing an underwater spill, comprising:

freely suspending a hydrocarbon fluid collector from a flotation assembly below surface for moving the hydrocarbon fluid collector above at least a plume emanating from an underwater hydrocarbon leak discharging fluids;

collecting the fluid discharged from the underwater hydrocarbon leak with the hydrocarbon fluid collector;

flowing the hydrocarbon fluids through a conduit extending between the hydrocarbon fluid collector and the flotation assembly; and controlling the size of one or more openings in the conduit for controlling introduction of water to the conduit or withdrawal of fluids from the conduit for varying the fluid density in the conduit for controlling a rate of flow therein.

34. A method of containing an underwater spill, comprising:

freely suspending a hydrocarbon fluid collector from a flotation assembly below surface for moving the hydrocarbon fluid collector above at least a plume emanating from an underwater hydrocarbon leak discharging fluids;

collecting the fluid discharged from the underwater hydrocarbon leak with the hydrocarbon fluid collector;

flowing the hydrocarbon fluids through a conduit extending between the hydrocarbon fluid collector and the flotation assembly; and disposing a series of intermediate hydrocarbon fluid collectors having a conduit extending upwardly therefrom to form a chain of plume concentrators between the underwater hydrocarbon leak and the hydrocarbon fluid collector, each plume concentrator gathering fluid; and refocusing the fluid to a smaller cross-sectional area in the conduit to rise in a plume to a next plume concentrator.

35. Apparatus for underwater hydrocarbon fluid spill containment, comprising:

a submerged hydrocarbon fluid collector, freely suspended without positioning cables and without being anchored, above at least a plume from an underwater hydrocarbon leak, having an opening for receiving and collecting fluids emanating from the underwater hydrocarbon leak in the at least a plume;

a flotation assembly positioned below surface, intermediate the surface and the submerged hydrocarbon fluid collector;

a conduit extending between the hydrocarbon fluid collector and the flotation assembly for flowing fluids collected in the hydrocarbon fluid collector to the flotation assembly, for transport to the surface;

thrusters on at least the hydrocarbon fluid collector for moving at least the hydrocarbon fluid collector laterally, vertically or both to position the at least the hydrocarbon collector with respect to the at least the plume from the underwater hydrocarbon leak; and a chain of plume concentrators disposed between the underwater hydrocarbon leak and the hydrocarbon fluid collector, the chain of plume concentrators collimating the plume of fluids emanating from the underwater hydrocarbon leak, wherein the chain of plume concentrators increase in size from a smallest concentrator adjacent the leak to a largest topmost concentrator adjacent the hydrocarbon collector.

36. The apparatus of claim 35 wherein the flotation assembly is mobile with the submerged hydrocarbon collector, the apparatus further comprising:

an independent collector flotation assembly for supporting the chain of plume concentrators, the topmost concentrator being attached thereto.

37. Apparatus for underwater hydrocarbon fluid spill containment, comprising:

a submerged hydrocarbon fluid collector, freely suspended above an underwater hydrocarbon leak, the collector having an opening for receiving and collecting fluids from at least a plume of discharged fluids emanating from the underwater hydrocarbon leak, the collector being moveable therewith;

a flotation assembly below surface, intermediate the surface and the hydrocarbon collector;

a conduit extending between the hydrocarbon fluid collector and the flotation assembly for flowing fluids collected in the hydrocarbon fluid collector to the flotation assembly, for transport to the surface;

a source of a hydrate dissipating medium within or below the hydrocarbon fluid collector or the conduit or both and immersed in the fluids therein for preventing hydrate formation or for dissipating hydrate, if formed therein; and a chain of plume concentrators disposed between the underwater hydrocarbon leak and the hydrocarbon fluid collector, the chain of plume concentrators collimating the plume of fluids emanating from the underwater hydrocarbon leak, wherein the chain of plume concentrators increase in size from a smallest concentrator adjacent the leak to a largest topmost concentrator adjacent the flotation assembly.

38. A method for containing an underwater spill, comprising freely suspending a hydrocarbon fluid collector from a flotation assembly positioned below surface, the flotation assembly positioned intermediate the surface and the collector for moveably positioning the hydrocarbon fluid collector above at least a plume emanating from an underwater hydrocarbon leak discharging fluids;

moving the hydrocarbon collector laterally and or vertically with respect to the at least the plume emanating from the underwater hydrocarbon leak using thrusters on at least the hydrocarbon fluid collector;

disposing a series of intermediate hydrocarbon fluid collectors to form a chain of plume concentrators between the underwater hydrocarbon leak and the hydrocarbon fluid collector, each plume concentrator gathering fluid and refocusing the fluid to a smaller cross-sectional area to rise in a plume to a next plume concentrator;

increasing a size of the plume concentrators from smallest adjacent the leak to largest adjacent the flotation assembly;

collecting the fluid discharged from the underwater hydrocarbon leak with the hydrocarbon fluid collector; and flowing the hydrocarbon fluids through a conduit extending between the hydrocarbon fluid collector and the flotation assembly.

* * * * *